US009740123B2

(12) United States Patent
Furukawa et al.

(10) Patent No.: US 9,740,123 B2
(45) Date of Patent: Aug. 22, 2017

(54) TONER FOR DEVELOPING ELECTROSTATIC LATENT IMAGES

(71) Applicant: Konica Minolta, Inc., Tokyo (JP)

(72) Inventors: Junichi Furukawa, Hachioji (JP); Shiro Hirano, Hachioji (JP); Junya Onishi, Hachioji (JP); Tatsuya Fujisaki, Hino (JP); Hidehito Haruki, Asaka (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/060,870

(22) Filed: Mar. 4, 2016

(65) Prior Publication Data

US 2016/0282736 A1 Sep. 29, 2016

(30) Foreign Application Priority Data

Mar. 25, 2015 (JP) ..... 2015-062441

(51) Int. Cl.
*G03G 9/087* (2006.01)
*G03G 9/08* (2006.01)

(52) U.S. Cl.
CPC ..... *G03G 9/08711* (2013.01); *G03G 9/0821* (2013.01); *G03G 9/08755* (2013.01)

(58) Field of Classification Search
CPC ..... G03G 9/0821; G03G 9/08711; G03G 9/08755
USPC ..... 430/109.3
See application file for complete search history.

(56) References Cited

U.S. PATENT DOCUMENTS

2014/0356780 A1* 12/2014 Kawamura ..... G03G 9/08724 430/109.3
2014/0363763 A1* 12/2014 Shibata ..... G03G 9/08724 430/109.3
2016/0370722 A1* 12/2016 Sugama ..... G03G 9/08755

FOREIGN PATENT DOCUMENTS

JP 2011170229 A 9/2011
JP 2013-54308 A 3/2013
JP 2013-156421 A 8/2013
JP 2013225096 A 10/2013
JP 2014167602 A 9/2014
JP 2017-009631 A * 1/2017

OTHER PUBLICATIONS

Japanese Patent Office J-Plat-Pat machine-assisted English-language translation of Japanese Patent 2017-009631 (A) (pub.date Jan. 2017).*
Notice of Reasons for Rejection dated Nov. 1, 2016 from corresponding Japanese Application; Patent Application No. 2015-062441; English translation of Notice of Reasons for Rejection; Total of 14 pages.

* cited by examiner

*Primary Examiner* — Janis L Dote
(74) *Attorney, Agent, or Firm* — Lucas & Mercanti, LLP

(57) ABSTRACT

A toner for developing electrostatic latent images contains a particulate toner which at least includes a colorant, a binder resin, a mold release agent, and a crystalline polyester resin. The binder resin contains a styrene-acrylic resin. The toner has a storage modulus G', a difference (X) between the maximum value and the minimum value of the storage modulus G', and a difference (Y) between the maximum value and the minimum value of a loss modulus G" within the range of 140 to 180° C. satisfying relationships expressed by Conditional expressions (1) $1.0\times10^2 \leq G' \leq 1.0\times10^3$, (2) $0 \leq X \leq 3.0\times10^2$, and (3) $0 \leq Y \leq 6.0\times10^2$.

6 Claims, No Drawings

TONER FOR DEVELOPING ELECTROSTATIC LATENT IMAGES

BACKGROUND OF THE INVENTION

1. Field of the Invention

The present invention relates to toners for developing electrostatic latent images. The present invention more specifically relates to a toner for developing electrostatic latent images which has compatibility between low-temperature fixing characteristics and stability.

2. Description of Related Art

Techniques recently developed in the field of electrophotographic imaging apparatuses, i.e., those for digital image processing and production of toners having smaller diameters enable formation of images with high resolution, and can provide prints produced directly from toner images in the printing field involving printing with printing plates.

These techniques can eliminate the step of making printing plates essential for the printing process. This results in quick production of high-quality prints, leading to application of these techniques especially to a small-lot printing field in which orders are received mainly in small quantities, for example, from about several hundreds to several thousands of prints.

Recent environmental concerns lead to investigation of a reduction in power consumption of imaging apparatuses, especially techniques of reducing the power consumption of fixing units. One of the techniques of reducing energy consumption of the fixing units is a so-called low-temperature fixing technique of fusing a toner at a low heating temperature, which has been examined for a reduction in warm-up time from a stand-by state and thus a reduction in energy consumption of the fixing units.

In addition to the low-temperature fixing technique, the small-lot printing field requires stable continuous printing of about several hundreds to several thousands of prints without a fluctuation in gloss level between the resulting prints.

For example, JP2011-170229A discloses use of a binder resin comprising a resin A containing a copolymer prepared with a styrene monomer and a (meth)acrylic monomer and a resin B containing a copolymer prepared with a methacrylate ester monomer and a radical polymerizable monomer having a plurality of carboxy groups.

The resin B present in an immiscible state in the resin A phase absorbs excess heat at high temperatures at which excess heat is readily applied to the fused toner. Hence, the fluidity of the toner during the low-temperature fixing process is maintained and a fluctuation in gloss is prevented.

Unfortunately, if two immiscible amorphous resins are present in the resin A phase, sufficient sharp-melt characteristics cannot be ensured, and fixing at significantly low temperature cannot be achieved.

To satisfy a requirement on a further reduction in temperature of the low-temperature fixing process, JP2013-225096A and JP2014-167602A each disclose a toner comprising a crystalline resin contained in an amorphous polyester resin to reduce the viscoelasticity of the toner being fused.

Unfortunately, the fused toner has a low storage modulus and a low loss modulus and the viscoelasticity of the toner is specified only at a certain temperature. Hence, a subtle change in temperature near the fixing temperature will lead to a significant variation in viscoelasticity, resulting in hot offsetting.

SUMMARY OF THE INVENTION

The present invention has been made in consideration of the problems and circumstances. An object of the present invention is to provide a toner for developing electrostatic latent images which enables stable continuous printing at low temperature while having a small fluctuation in the difference in gloss level of the image between the front and rear surfaces of one sheet and between sheets.

In order to realize the above object, according to a first aspect of the present invention, there is provided a toner for developing electrostatic latent images, the toner containing a particulate toner which at least includes a colorant, a binder resin, a mold release agent, and a crystalline polyester resin, wherein the binder resin contains a styrene-acrylic resin, and the toner has a storage modulus G', a difference (X) between the maximum value and the minimum value of the storage modulus G', and a difference (Y) between the maximum value and the minimum value of a loss modulus G" within the range of 140 to 180° C. satisfying relationships expressed by Conditional expressions (1) to (3):

$$1.0\times10^2 \leq G' \leq 1.0\times10^3 \quad \text{Conditional expression (1):}$$

$$0 \leq X \leq 3.0\times10^2 \quad \text{Conditional expression (2):}$$

$$0 \leq Y \leq 6.0\times10^2. \quad \text{Conditional expression (3):}$$

DETAILED DESCRIPTION OF THE PREFERRED EMBODIMENT

Hereinafter, an embodiment of the present invention will be described. Though various technical limitations which are preferable to perform the present invention are included in the after-mentioned embodiment, the scope of the invention is not limited to the following embodiment and the illustrated examples.

A toner according to the present invention for developing electrostatic latent images contains a particulate toner which at least comprises a colorant, a binder resin, a mold release agent, and a crystalline polyester resin, wherein the binder resin contains a styrene-acrylic resin, and the toner has a storage modulus G', a difference (X) between the maximum value and the minimum value of the storage modulus G', and a difference (Y) between the maximum value and the minimum value of a loss modulus G" within the range of 140 to 180° C. satisfying relationships expressed by Conditional expressions (1) to (3). This characteristic is common to inventions according to claims.

In a preferred embodiment according to the present invention, the ratio of a weight average molecular weight (Mw) to a number average molecular weight (Mn) satisfies Conditional Expression (4) to attain the advantageous effects of the present invention. A ratio Mw/Mn of 2.0 or more is preferred because the polymer component in the binder resin maintains the immiscibility with the crystalline polyester resin and the styrene-acrylic resin, reducing a fluctuation in viscoelasticity of the toner caused by a variation in temperature near the fixing temperature. A ratio Mw/Mn of 6.0 or less is preferred because the binder resin is readily miscible with the crystalline polyester resin to ensure fusing and fixing of the toner at a heating temperature lower than conventional heating temperatures.

In a preferred embodiment according to the present invention, the weight average molecular weight (Mw) ranges from 25000 to 60000 and the number average molecular weight (Mn) ranges from 8000 to 15000 to attain the advantageous effects of the present invention. The toner preferably has a weight average molecular weight of 25000 or more and a number average molecular weight of 8000 or more to more certainly prevent hot offsetting which causes contamination of images and the internal spaces of the image forming apparatuses. The toner preferably has a weight average molecular weight of 60000 or less and a number average molecular weight of 15000 or less to more certainly prevent breakage of the melted toner layer during the fixing process, and thus to ensure fusion and fixation of the toner at a heating temperature lower than conventional heating temperatures.

In a preferred embodiment according to the present invention, the crystalline polyester resin includes a crystalline polyester resin composed of a polymerizable vinyl monomer and a polymerizable polyester monomer bonded to the polymerizable vinyl monomer to attain the advantageous effects of the present invention. In such a toner, the binder resin is partially miscible with the crystalline polyester resin, resulting in the compatibility between a reduced variation in viscoelasticity of the toner near the fixing temperature and the low-temperature fixing characteristics of the toner.

In a preferred embodiment according to the present invention, the content of the polymerizable vinyl monomer in the crystalline polyester resin is within the range of 1 to 30 mass % of the total mass of the crystalline polyester resin composed of the polymerizable vinyl monomer and the polymerizable polyester monomer bonded to the polymerizable vinyl monomer to attain the advantageous effects of the present invention. The content of the polymerizable vinyl monomer is preferably 1 mass % or more because the binder resin is readily miscible with the crystalline polyester resin to ensure the fusion and fixation of the toner at a heating temperature lower than conventional heating temperatures. The content of the polymerizable vinyl monomer is preferably 30 mass % or less because the binder resin is not completely miscible with the crystalline polyester resin, preventing hot offsetting which causes contamination of images and the internal spaces of the image forming apparatuses and reducing a fluctuation in viscoelasticity of the toner due to a variation in temperature near the fixing temperature.

In a preferred embodiment according to the present invention, the crystalline polyester resin contains a non-modified crystalline polyester resin to attain the advantageous effects of the present invention. Such a crystalline polyester resin preferably ensures the binder resin kept immiscible with the crystalline polyester resin near the fixing temperature and a reduced fluctuation in viscoelasticity of the toner due to a variation in temperature.

In a preferred embodiment according to the present invention, the crystalline polyester resin has an acid value within the range of 5 to 30 mgKOH/g to attain the advantageous effects of the present invention. The crystalline polyester resin preferably has an acid value of 5 mgKOH/g or more because the affinity of the binder resin with the crystalline polyester resin increases to ensure the fusion and fixation of the toner at a heating temperature lower than conventional heating temperatures. The crystalline polyester resin preferably has an acid value of 30 mgKOH/g or less to avoid significantly high affinity of the binder resin with the crystalline polyester resin, preventing hot offsetting which causes contamination of images and the internal spaces of the image forming apparatuses and reducing a fluctuation in viscoelasticity of the toner due to a variation in temperature near the fixing temperature.

Although the mechanism or the action attaining advantageous effects of the present invention is not clarified, the present inventor infers the mechanism or action as follows.

The traditional low-temperature fixing process is implemented through thermal fusing of an amorphous resin with a crystalline resin during the fixing process to reduce the elastic modulus of a toner near the fixing temperature. Such a process significantly reduces the viscoelasticity of the toner near the fixing temperature, unintentionally increasing the difference in gloss level of images between the front and rear surfaces of one sheet and between sheets if the fixing roller temperature is fluctuated during double-sided printing or continuous printing.

The compatibility between the low-temperature fixing characteristics of the toner and the stability of the image gloss level requires low elastic modulus near the fixing temperature and adequately maintained elastic modulus at high temperature.

The present inventor believes that in the present invention, a crystalline polyester resin is introduced into a styrene-acrylic resin to control these resins such that the styrene-acrylic resin is partially but not completely miscible with the crystalline polyester resin during the thermal fixing process to maintain the elastic modulus at a high temperature near the fixing temperature, resulting in compatibility between the low-temperature fixing characteristics of the toner and the stability of the image gloss level.

The present invention, components thereof, and embodiments and aspects for implementing the present invention will now be described in detail. Throughout the specification, the term to between numeric values indicates that the numeric values before and after the term are inclusive as the lower limit and the upper limit, respectively.

<<Toner According to the Present Invention for Developing Electrostatic Latent Images>>

A toner according to the present invention for developing electrostatic latent images (hereinafter, also simply referred to as "toner") contains a particulate toner which at least comprises a colorant, a binder resin, a mold release agent, and a crystalline polyester resin, wherein the binder resin contains a styrene-acrylic resin, and the toner has a storage modulus G', a difference (X) between the maximum value and the minimum value of the storage modulus G', and a difference (Y) between the maximum value and the minimum value of a loss modulus G" within the range of 140 to 180° C. satisfying relationships expressed by Conditional expressions (1) to (3):

$$1.0\times10^2 \le G' \le 1.0\times10^3 \quad \text{Conditional expression (1):}$$

$$0 \le X \le 3.0\times10^2 \quad \text{Conditional expression (2):}$$

$$0 \le Y \le 6.0\times10^2. \quad \text{Conditional expression (3):}$$

(Storage Modulus and Loss Modulus)

The storage modulus indicates the elastic component of dynamic viscoelasticity described later. Specifically, the storage modulus indicates the ratio of the in-phase elastic stress to the strain generated through application of an external force to a toner, and corresponds to the energy elastically stored in the toner of the external force applied to the toner.

In the present invention, the storage modulus G' is an index for determining the fusion characteristics of the toner needed for low-temperature fixing, and a toner having a storage modulus G' within the range of $1.0\times10^2$ to $1.0\times10^3$ at a temperature within the range of 140 to 180° C. indicates that the toner is readily fused during the low-temperature fixing process. The toner more preferably has a storage modulus G' within the range of $1.0\times10^2$ to $6.0\times10^2$.

The difference (X) between the maximum value and the minimum value of the storage modulus G' according to the present invention is an index indicating a change in storage modulus during the low-temperature fixing process, and the difference (X) between the maximum value and the minimum value of the storage modulus G' at a temperature within the range of 140 to 180° C. is within the range of 0 to $3.0\times10^2$. Accordingly, a lower difference (X) indicates a smaller fluctuation in elasticity of the toner, so that the resulting image readily has uniform gloss. The difference (X) is more preferably within the range of 0 to $2.0\times10^2$.

The loss modulus indicates the viscous component of the dynamic viscoelasticity. Specifically, the loss modulus indicates the ratio of an out-of-phase elastic stress to the strain generated through application of an external force to a toner, and corresponds to the energy dissipating as heat of the external force received by the toner.

In the present invention, the difference (Y) between the maximum value and the minimum value of the loss modulus G" is an index indicating a change in loss modulus during the low-temperature fixing process. The difference (Y) between the maximum value and the minimum value of the loss modulus G" at a temperature within the range of 140 to 180° C. is within the range of 0 to $6.0\times10^2$. Accordingly, a lower difference (Y) indicates a smaller fluctuation in viscosity of the toner, so that the resulting image readily has uniform gloss. The difference (Y) is preferably within the range of 0 to $4.0\times10^2$.

The present inventor, who has focused on the storage modulus of the toner in the present invention as described above, believes that the storage modulus and the loss modulus within the specific ranges at a temperature within the specific range barely fluctuate the flexibility of the toner and thus barely change the states of toner particles on image surfaces according to the fixing temperature, reducing the difference in gloss level. The advantageous effects of the present invention can be more clearly demonstrated by use of such a toner.

The storage modulus and the loss modulus can be calculated based on the dynamic viscoelasticity.

Throughout the specification, the dynamic viscoelasticity is an index used to evaluate the viscoelasticity of a sample, and is obtained by applying a distortion or a stress varying with time, such as sine vibration, to the sample, and measuring the stress or the distortion of the sample. Such viscoelasticity obtained through sine vibration is referred to as dynamic viscoelasticity in which the elastic modulus obtained from the sine vibration is expressed in terms of a complex number.

In the following expression, the elastic modulus G represents the ratio of a stress σ applied to a sample to the strain γ generated by the action of the stress σ. The elastic modulus in the dynamic viscoelasticity is referred to as complex modulus G*. In detail, the complex modulus G* in the dynamic viscoelasticity is expressed by the following expression:

$$G^*=\sigma^*/\gamma^*$$

where the stress is σ*, and the strain is γ*.

The real part of the complex modulus G* is referred to as storage modulus, and the imaginary part thereof is referred to as loss modulus. The storage modulus, which is a factor of specifying the toner used in the present invention, will now be described.

If a sample receives a sinusoidal distortion γ with an amplitude $\gamma_0$ and an angular frequency ω, the sinusoidal distortion γ is expressed by $\gamma=\gamma_0 \cos \omega t$.

A stress having the same angular frequency as that of the sinusoidal distortion is generated in the sample which receives the sinusoidal distortion. The stress σ precedes the distortion γ by a phase δ. The stress σ is then expressed by $\sigma=\sigma_0 \cos(\omega t+\delta)$.

These expressions are converted into expressions with complex numbers by Euler's formula $e^{i\omega t}=\cos \omega t+i \sin \omega t$. The sinusoidal distortion γ* is expressed by the expression $\gamma^*=\gamma_0 \exp(i\omega t)$, and the stress σ* is expressed by the expression $\sigma^*=\sigma_0 \exp(i(\omega t+\delta))$.

These expressions are substituted into the expression $G^*=\sigma^*/\gamma^*$ (where G* is the complex modulus); then, $$G^* = (\sigma_0/\gamma_0)\exp\delta$$

$$= (\sigma_0/\gamma_0)(\cos\delta + i\sin\delta)$$

Let that $G^*=G'+iG''$, then, $G'=(\sigma_0/\gamma_0)\cos \delta$, and $G''=(\sigma_0/\gamma_0)\sin \delta$.

These expressions indicate that the elastic energy stored in a viscoelastic substance within one period is proportional to G' and the energy of the viscoelastic substance lost as heat is proportional to G". Accordingly, the real part G' is referred to as storage modulus, and the imaginary part G" is referred to as loss modulus.

The storage modulus and the loss modulus of the toner according to the present invention can be determined with MCR302 (made by Anton Paar GmbH) in accordance with the following procedures (1) to (5).

(1) A toner containing an external additive is placed in a petri dish, is leveled, and is left for 12 hours or more under an environment at a temperature of 20±1° C. and a relative humidity of 50±5%. This sample (0.2 g) is placed in a compression molding machine, and a load of 3 t is applied to the sample for 30 seconds to prepare a pellet having a diameter of 1 cm and a thickness of 3 mm.

(2) The pellet is placed on a parallel plate having a diameter of 10 mm.

(3) The measuring unit is set at a temperature that is 20° C. lower than the softening point of the toner, and the gap of the parallel plate is set at 1.5 mm. These settings allow the measuring unit to be heated to a temperature 20° C. lower than the softening point of the toner and the pellet to be compressed until the gap reaches 1 mm. The toner squeezed out of the parallel plate is scraped off with a spatula. The sample is then cooled to 30° C.

(4) The temperature of the measuring unit is set at 30° C. The measuring unit is heated to 200° C. at a heating rate of 3° C./min while a sinusoidal vibration at a frequency of 1.0 Hz is being applied. The complex modulus of the sample at a temperature within the range of 140 to 180° C. is measured. The interval between points to be measured is 10 seconds. The strain is applied within the range of 0.05 to 15% in an automatic strain control mode.

(5) The storage modulus and the loss modulus are calculated from the complex modulus.

The low-temperature fixing characteristics of the toner in the present invention can be ensured through appropriate design of the composition of the monomer and the molecular weight of the monomer. A highly elastic resin as a third component compounded in the toner can enhance the viscoelasticity of the toner, so that high-temperature offsetting can be prevented while the low-temperature fixing characteristics of the toner are ensured. The highly elastic resin is preferably compounded in the toner by a method of preparing a toner, such as emulsion aggregation. The highly elastic resin can be dispersed in the toner through optimization of association conditions.

<Particulate Toner>

The toner for developing electrostatic latent images according to the present invention contains a particulate toner which at least comprises a colorant, a binder resin, a mold release agent, and a crystalline polyester resin, and may contain other optional components, such as a charge control agent.

The ratio of the weight average molecular weight (Mw) of the particulate toner to the number average molecular weight (Mn) thereof preferably satisfies Conditional Expression (4): $2.0 \leq Mw/Mn \leq 6.0$.

The particulate toner preferably has a weight average molecular weight (Mw) within the range of 25000 to 60000 and a number average molecular weight (Mn) within the range of 8000 to 15000. The particulate toner more preferably has a weight average molecular weight (Mw) within the range of 30000 to 50000 and a number average molecular weight (Mn) within the range of 9000 to 12000.

It is believed that a weight average molecular weight and a number average molecular weight of the particulate toner within these ranges more preferably contribute to low-temperature fixing characteristics and well-balanced gloss.

In other words, it is believed that a toner having a weight average molecular weight of 8000 or more and a number average molecular weight of 9000 or more avoids increases in viscosity of the toner and the internal aggregation force of the toner to prevent breakage of the fused toner layer during the fixing process. As a result, hot offsetting which causes contamination of images and the internal spaces of the image forming apparatuses is more certainly prevented.

It is also believed that a weight average molecular weight of 15000 or less and a number average molecular weight of 12000 or less avoids significant increases in the viscosity of the toner and the internal aggregation force of the toner to more certainly prevent breakage of the fused toner layer during the fixing process. It is also believed that the toner can be more certainly fused and fixed at a heating temperature lower than conventional heat temperatures.

The particulate toner in the present invention preferably has a particle size within the range of 3 to 10 μm, which is given as a volume median diameter (D50% diameter). A particle size within this range is preferred to produce images with high definition.

(Binder Resin)

The binder resin forming the particulate toner according to the present invention contains at least a crystalline polyester resin, and may contain an optional resin.

Specifically, the crystalline polyester resin can be contained in an amount of 5 mass % or more of the total binder resin forming the particulate toner.

A binder resin preferably used is a thermoplastic resin. Any thermoplastic resin usually used as a binder resin for the toner can be used. Examples of such thermoplastic resins include styrene resins; acrylic resins, such as alkyl acrylate and alkyl methacrylate; styrene-acrylic resins; polyester resins; silicone resins; olefin resins; amide resins; and epoxy resins. These resins may be used alone or in combination.

A particularly preferred binder resin contains a styrene-acrylic resin prepared through polymerization of a styrene monomer and an acrylic monomer. Use of such a binder resin can make the styrene-acrylic resin partially miscible with the crystalline polyester during the thermal fixing process to ensure the low-temperature fixing characteristics, and can prevent the styrene-acrylic resin from being completely miscible with the crystalline polyester. Such a binding resin can further reduce a fluctuation in the storage modulus and the loss modulus at a temperature within the range of 140 to 180° C., and thus can maintain these values substantially constant.

The styrene-acrylic resin preferably has a weight average molecular weight (Mw) within the range of 25000 to 60000 and a number average molecular weight (Mn) within the range of 8000 to 15000 to ensure the low-temperature fixing characteristics of the toner and the stability of the gloss level.

Preferred polymerizable monomers used in the styrene-acrylic resin are aromatic vinyl monomers and (meth)acrylate ester monomers having ethylenically unsaturated bonds and allowing radical polymerization.

Examples of the aromatic vinyl monomers include styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene, and derivatives thereof. These aromatic vinyl monomers may be used alone in combination.

Examples of (meth)acrylate ester monomers include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, β-hydroxyethyl acrylate, γ-aminopropyl acrylate, stearyl methacrylate, dimethylaminoethyl methacrylate, and diethylaminoethyl methacrylate. These (meth)acrylate ester monomers may be used alone or in combination. Among these monomers, styrene monomers can be preferably used in combination with acrylate ester monomers or methacrylate ester monomers.

A third vinyl monomer can be used as the polymerizable monomer. Examples of the third vinyl monomer include acid monomers, such as acrylic acid, methacrylic acid, maleic anhydride, and vinyl acetate, acrylamides, methacrylamides, acrylonitriles, ethylene, propylene, butylene, vinyl chloride, N-vinylpyrrolidone, and butadiene.

A polyfunctional vinyl monomer can also be used as the polymerizable monomer. Examples of the polyfunctional vinyl monomer include diacrylates, such as ethylene glycol, propylene glycol, butylene glycol, and hexylene glycol; divinylbenzene; and dimethacrylates and trimethacrylates of alcohols having three or more hydroxy groups, such as pentaerythritol and trimethylolpropane.

The binder resin according to the present invention is preferably prepared through emulsion polymerization. In emulsion polymerization, a polymerizable monomer, such as styrene or acrylate ester, is dispersed in an aqueous medium, and is polymerized to prepare a binder resin. A surfactant is preferably used to disperse the polymerizable monomer in an aqueous medium. Polymerization can be performed using a polymerization initiator and a chain transfer agent.

(Polymerization Initiator)

The polymerization initiator used in preparation of the binder resin through polymerization can be any known polymerization initiator. Specific examples thereof include peroxides, such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, tert-hydroperoxide pertriphenylacetate, tert-butyl performate, tert-butyl peracetate, tert-butyl perbenzoate, tert-butyl perphenylacetate, tert-butyl permethoxyacetate, and tert-butyl per-N-(3-toluyl)palmitate; and azo compounds, such as 2,2'-azobis(2-amidinopropane) dihydrochloride, 2,2'-azobis-(2-amidinopropane) nitrate, 1,1'-azobis(sodium 1-methylbutyronitrile-3-sulfonate), 4,4'-azobis-4-cyanovaleric acid, and poly(tetraethyleneglycol-2,2'-azobisisobutyrate). Although the amount of the polymerization initiator to be added varies according to the desired molecular weight and the desired molecular weight distribution of the target polymer, the polymerization initiator is preferably added in an amount of 0.1 to 5.0 mass % of the polymerizable monomer.

(Chain Transfer Agent)

A chain transfer agent is preferably added together with the polymerizable monomer during preparation of the binder resin. Addition of the chain transfer agent can control the molecular weight of the polymer. Any common chain transfer agent can be used in the polymerization process of the aromatic vinyl monomer and the (meth)acrylate ester monomer listed above to control the molecular weight of the styrene-acrylic polymerizable monomer. Examples thereof include alkyl mercaptans and mercapto fatty acid esters.

Although the amount of chain transfer agent to be added varies according to the desired molecular weight and the desired molecular weight distribution of the target polymer, the chain transfer agent is preferably added in an amount within the range of 0.1 to 5.0 mass % of the polymerizable monomer.

(Surfactant)

In emulsion polymerization of the polymerizable monomer dispersed in an aqueous medium to prepare a binder resin, a dispersion stabilizer is usually added to prevent aggregation of liquid droplets containing the polymerizable monomer dispersed in the aqueous medium. Known surfactants can be used as the dispersion stabilizer, and can be selected from cationic surfactants, anionic surfactants, and nonionic surfactants. These surfactants may be used in combination. The dispersion stabilizer can also be used for dispersions of colorants or offsetting inhibitors.

Specific examples of the cationic surfactants include dodecylammonium bromide, dodecyltrimethylammonium bromide, dodecylpyridinium chloride, dodecylpyridinium bromide, and hexadecyltrimethylammonium bromide.

Specific examples of the nonionic surfactants include dodecyl polyoxyethylene ether, hexadecyl polyoxyethylene ether, nonylphenyl polyoxyethylene ether, lauryl polyoxyethylene ether, sorbitan monooleate polyoxyethylene ether, styrylphenyl polyoxyethylene ether, and monodecanoyl sucrose.

Specific examples of the anionic surfactants include aliphatic soaps, such as sodium stearate and sodium laurate, sodium lauryl sulfate, sodium dodecylbenzenesulfonate, and sodium polyoxyethylene(2) lauryl ether sulfate.

(Crystalline Polyester Resin)

The content of the crystalline polyester resin in the toner is preferably within the range of 5 to 20 mass % in view of the low-temperature fixing characteristics of the toner and the stability of the gloss level.

The crystalline polyester resin refers to a known polyester resin prepared through a polycondensation reaction of a di- or higher valent carboxylic acid (polyvalent carboxylic acid) with a di- or higher hydric alcohol (polyhydric alcohol) and having a clear endothermic peak in a curve obtained by differential scanning calorimetry (DSC) rather than exhibiting a step-wise endothermic change.

The clear endothermic peak specifically indicates a peak having a half width of the endothermic peak within the range of 15° C. in the curve obtained by differential scanning calorimetry (DSC) at a heating rate of 10° C./min.

The polyvalent carboxylic acid has two or more carboxy groups in the molecule.

Specific examples of the polyvalent carboxylic acid include saturated aliphatic dicarboxylic acids, such as oxalic acid, malonic acid, succinic acid, adipic acid, sebacic acid, azelaic acid, and n-dodecylsuccinic acid; alicyclic dicarboxylic acids, such as cyclohexanedicarboxylic acid; aromatic dicarboxylic acids, such as phthalic acid, isophthalic acid, and terephthalic acid; polyvalent carboxylic acids having three or higher valencies, such as trimellitic acid and pyromellitic acid; and anhydrides of these carboxylic acid compounds or alkyl esters thereof having 1 to 3 carbon atoms.

These compounds may be used alone or in combination.

The polyhydric alcohol has two or more hydroxyl groups in the molecule.

Specific examples thereof include aliphatic diols, such as 1,2-propanediol, 1,3-propanediol, 1,4-butanediol, 1,5-pentanediol, 1,6-hexanediol, 1,7-heptanediol, 1,8-octanediol, neopentyl glycol, and 1,4-butenediol; and polyhydric alcohols having three or more hydroxyl groups, such as glycerol, pentaerythritol, trimethylolpropane, and sorbitol.

These polyhydric alcohols may be used alone or in combination.

The melting point of the crystalline polyester resin is within the range of preferably 60 to 90° C., more preferably 70 to 85° C.

A crystalline polyester resin having a melting point within this range results in a toner having sufficient low-temperature fixing characteristics.

The melting point of the crystalline polyester resin can be controlled by the resin composition.

The melting point of the crystalline polyester resin is determined as follows.

The melting point of the crystalline polyester resin indicates the temperature at the peak of an endothermic curve of the resin, which is determined through differential scanning calorimetric (DSC) analysis with DIAMOND DSC (made by PerkinElmer Inc.).

Specifically, a sample (crystalline polyester resin) (1.0 mg) is sealed in an aluminum pan (KIT NO. B0143013), and is set on a sample holder of DIAMOND DSC. The temperature of the sample is controlled from 0 to 200° C. through a series of operation of first heating, cooling, and second heating at a heating rate of 10° C./min and a cooling rate of 10° C./min. The data on the second heating is analyzed to determine the melting point of the sample.

The molecular weight of the crystalline polyester resin determined by gel permeation chromatography (GPC) preferably ranges from 1000 to 15000 in terms of the number average molecular weight (Mn) in view of the low-temperature fixing characteristics of the toner and the stability of the gloss level.

The molecular weight is determined by gel permeation chromatography (GPC) as follows.

GPC is performed with HLC-8120 GPC (made by Tosoh Corporation) provided with a TSKGUARD column and three TSKGELSUPERHZ-M columns (made by Tosoh Corporation). While the column temperature is kept at 40° C., a carrier solvent tetrahydrofuran (THF) is fed at a flow rate of 0.2 ml/min. A sample (resin) is dissolved in tetrahydrofuran with an ultrasonic disperser at room temperature for five minutes such that the sample content is 1 mg/ml, and is filtered through a membrane filter having a pore size of 0.2 μm to prepare a sample solution.

The sample solution (10 μL) and the carrier solvent are injected into the gel permeation chromatograph, and the level of components in the sample solution is detected with a refractive index detector (RI detector). The molecular weight distribution of the sample is then calculated from the calibration curve produced with monodispersed standard polystyrene particles.

The calibration curve is produced with ten standard polystyrenes.

(Hybrid Resin)

A hybrid crystalline polyester resin (hybrid resin) is composed of a crystalline polyester resin unit chemically bonded to an amorphous resin unit composed of a resin other than the polyester resin.

The crystalline polyester resin unit of the hybrid resin indicates a portion derived from a crystalline polyester resin. In other words, the crystalline polyester resin unit indicates a chain having the same chemical structure as that of the chain forming the crystalline polyester resin. The amorphous resin unit composed of a resin other than the polyester resin indicates a portion derived from an amorphous resin unit composed of a resin other than the polyester resin. In other words, the amorphous resin unit indicates a chain having the same chemical structure as that of the chain forming an amorphous resin other than the polyester resin.

The weight average molecular weight (Mw) of the hybrid resin is preferably within the range of 5000 to 100000, more preferably 7000 to 50000, particularly preferably 8000 to 40000 to ensure compatibility between sufficient low-temperature fixing characteristics and excellent long-term storage stability.

A hybrid resin having a weight average molecular weight (Mw) of 100000 or less results in a toner having sufficient low-temperature fixing characteristics. A hybrid resin having a weight average molecular weight (Mw) of 5000 or more can prevent excess miscibility between the hybrid resin and the amorphous resin during storage of the toner, leading to effectively reduced image defects caused by fused toner particles.

[Crystalline Polyester Resin Unit]

The crystalline polyester resin unit indicates a portion derived from a known polyester resin prepared through a polycondensation reaction of a di- or higher carboxylic acid (polyvalent carboxylic acid) with a di- or higher hydric alcohol (polyhydric alcohol), and having a clear endothermic peak in a curve obtained by differential scanning calorimetry of the toner rather than exhibiting a step-wise endothermic change.

The clear endothermic peak indicates a peak having a half width of the endothermic peak within the range of 15° C. in the curve obtained by the differential scanning calorimetry at a heating rate of 10° C./min.

Any crystalline polyester resin unit defined above can be used.

For example, resins having a structure composed of the main chain of the crystalline polyester resin unit copolymerized with another component and resins having a structure composed of the crystalline polyester resin unit copolymerized with a main chain of another component correspond to the hybrid resin having the crystalline polyester resin unit according to the present invention if the toners containing these resins have clear endothermic peaks.

The polyvalent carboxylic acid component and the polyhydric alcohol component each have preferably the valence of 2 to 3, particularly preferably the valence of 2. A particularly preferred embodiment in which the respective valences of the dicarboxylic acid component and the diol component are 2 will be described.

A dicarboxylic acid component preferably used is an aliphatic dicarboxylic acid. An aromatic dicarboxylic acid may also be used in combination. A linear aliphatic dicarboxylic acid can be preferably used. The linear aliphatic dicarboxylic acid advantageously enhances the crystallinity of the crystalline polyester resin unit. These dicarboxylic acid components may be used alone or in combination.

Examples of the aliphatic dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid (dodecanedioic acid), 1,13-tridecanedicarboxylic acid, 1,14-tetradecanedicarboxylic acid, 1,16-hexadecanedicarboxylic acid, and 1,18-octadecane dicarboxylic acid. Lower alkyl esters and acid anhydrides thereof may also be used.

Among these aliphatic dicarboxylic acids, preferred are aliphatic dicarboxylic acids having 6 to 12 carbon atoms to attain the advantageous effects of the present invention described above.

Examples of the aromatic dicarboxylic acid usable in combination with the aliphatic dicarboxylic acid include terephthalic acid, isophthalic acid, orthophthalic acid, t-butylisophthalic acid, 2,6-naphthalenedicarboxylic acid, and 4,4'-biphenyldicarboxylic acid. Among these aromatic dicarboxylic acids, preferably used are terephthalic acid, isophthalic acid, and t-butylisophthalic acid, which are readily available and emulsifiable.

The content of the aliphatic dicarboxylic acid in the dicarboxylic acid component for forming the crystalline polyester resin unit is preferably 50 mol % or more, more preferably 70 mol % or more, still more preferably 80 mol % or more, particularly preferably 100 mol %. Such a dicarboxylic acid component containing 50 mol % or more aliphatic dicarboxylic acid can contribute to sufficient crystallinity of the crystalline polyester resin unit.

A diol component preferably used is an aliphatic diol. The diol component may contain an optional diol other than the aliphatic diol. A linear aliphatic diol is preferably used. Use of the linear aliphatic diol advantageously enhances the crystallinity crystalline polyester resin unit. These diol components may be used alone or in combination.

Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-dodecanediol, 1,11-undecanediol, 1,12-dodecanediol, 1,13-tridecanediol, 1,14-tetradecanediol, 1,18-octadecanediol, and 1,20-eicosanediol.

Among these aliphatic diols, preferred diol components are aliphatic diols having 2 to 12 carbon atoms. More preferred are aliphatic diols having 6 to 12 carbon atoms, which contributes to the advantageous effects of the present invention, as described above.

Examples of the optional diol other than the aliphatic diol include diols having double bonds and those having sulfonate groups. Specific examples of the diols having double bonds include 2-butene-1,4-diol, 3-butene-1,6-diol, and 4-butene-1,8-diol.

The content of the aliphatic diol in the diol component for forming the crystalline polyester resin unit is preferably 50 mol % or more, more preferably 70 mol % or more, still more preferably 80 mol % or more, particularly preferably 100 mol %. Such a diol component containing 50 mol % or more aliphatic diol can contribute to the crystallinity of the crystalline polyester resin unit, resulting in a toner having excellent low-temperature fixing characteristics and gloss in images finally formed.

In use of the diol component and the dicarboxylic acid component, the equivalent ratio [OH]/[COOH] of the hydroxyl group [OH] of the diol component to the carboxy group [COOH] of the dicarboxylic acid component is preferably 1.5/1 to 1/1.5, more preferably 1.2/1 to 1/1.2.

The crystalline polyester resin unit can be formed by any process. The unit can be formed through polycondensation (esterification) of a polyvalent carboxylic acid and a polyhydric alcohol in the presence of a known esterification catalyst.

Examples of the catalyst usable in preparation of the crystalline polyester resin unit include compounds of alkali metals, such as sodium and lithium; compounds of alkaline earth metals, such as magnesium and calcium; compounds of metals, such as aluminum, zinc, manganese, antimony, titanium, tin, zirconium, and germanium; phosphorous acid compounds; phosphoric acid compounds; and amine compounds.

Specific examples of the tin compounds include dibutyltin oxide, tin octylate, tin dioctylate, and salts thereof. Examples of the titanium compounds include titanium alkoxides, such as tetranormal butyl titanate, tetraisopropyl titanate, tetramethyl titanate, and tetrastearyl titanate; titanium acylate, such as poly(hydroxytitaniumstearate); and titanium chelates, such as titanium tetraacetylacetonate, titanium lactate, and titanium triethanol aminato. Examples of the germanium compounds include germanium dioxide. Examples of the aluminum compounds include oxides, such as poly(aluminum hydroxide); aluminum alkoxides; and tributyl aluminate. These compounds may be used alone or in combination.

Polymerization can be performed at any temperature. A preferred polymerization temperature is within the range of 150 to 250° C. Polymerization can also be performed for any hour, preferably within the range of 0.5 to 10 hours. Polymerization can be performed under a reduced inner pressure of the reaction system.

The components contained in the respective units in the hybrid resin and their proportions can be determined by NMR or methylation reaction pyrolyzer-gas chromatography/mass spectrometry (Py-GC/MS), for example.

The hybrid resin contains the crystalline polyester resin unit and an amorphous resin unit composed of a resin other than the crystalline polyester resin, which will be described in detail later. The hybrid resin can be any one of block copolymers and graft copolymers composed of the crystalline polyester resin unit and the amorphous resin unit composed of a resin other than the crystalline polyester resin. A preferred hybrid resin is a graft copolymer. Such a graft copolymer facilitates control of the orientation of the crystalline polyester resin unit, resulting in a hybrid resin having sufficient crystallinity.

Furthermore, the crystalline polyester resin unit is preferably grafted to the main chain of the amorphous resin unit composed of a resin other than the crystalline polyester resin from the above-described viewpoint. In other words, the hybrid crystalline polyester resin is preferably a graft copolymer composed of the main chain of the amorphous resin unit composed of a resin other than the polyester resin and the side chain of the crystalline polyester resin unit.

Such a configuration can enhance the orientation of the crystalline polyester resin unit to enhance the crystallinity of the hybrid resin.

The hybrid resin may have a substituent introduced thereinto, such as a sulfonate group, a carboxy group, or a urethane group. The substituent can be introduced into the crystalline polyester resin unit or in the amorphous resin unit composed of a resin other than the polyester resin, which will be described in detail below.

Examples of the resin usable as the amorphous resin unit include, but should not be limited to, polyurethane resins, amorphous polyester resins, styrene-acrylic resins, polystyrene resins, and styrene-butadiene resins. These resins may be urethane-, urea-, or epoxy-modified. Among these resins, suitably used are styrene-acrylic resins because of the affinity with the binder resin.

[Amorphous Resin Unit Composed of Resin Other than Polyester Resin]

The amorphous resin unit composed of a resin other than the polyester resin (hereinafter, also simply referred to as "amorphous resin unit") indicates an essential unit for controlling the affinity of the amorphous resin contained in the binder resin with the hybrid resin.

The amorphous resin unit can enhance the affinity of the hybrid resin with the amorphous resin. As a result, the hybrid resin is readily entrained into the amorphous resin, resulting in an enhancement in charging uniformity.

The amorphous resin unit is a portion derived from an amorphous resin other than the crystalline polyester resin. The amorphous resin unit contained in the hybrid resin (and in the toner) can be confirmed through identification of the chemical structure by NMR or methylation reaction Py-GC/MS.

The results of the differential scanning calorimetry (DSC) performed on a resin having the same chemical structure and the same molecular weight as those of the amorphous resin unit show that the resin has no melting point but has a relatively high glass transition temperature (Tg). In the DSC of the resin having the same chemical structure and the same molecular weight as those of the amorphous resin unit, the glass transition temperature (Tg1) in the first heating process is within the range of preferably 30 to 80° C., particularly preferably 40 to 65° C. The glass transition temperature (Tg1) can be determined by the procedure described in Examples.

Any amorphous resin unit defined above can be used. For example, if toners contain resins having a structure composed of the main chain of the amorphous resin unit copolymerized with another component and resins having a structure composed of the amorphous resin unit copolymerized with the main chain of another component, these resins correspond to the hybrid resin having the amorphous resin unit according to the present invention because these resins have the amorphous resin unit.

The amorphous resin unit is preferably composed of a resin similar to the amorphous resin contained in the binder resin (namely, resin other than the hybrid resin). Such an amorphous resin unit more significantly enhances the affinity of the hybrid resin with the amorphous resin. As a result, the hybrid resin more readily merges into the amorphous resin to more significantly enhance charging uniformity.

Throughout the specification, the term "similar resins" indicates resins having the same characteristic chemical bond in their repeating units. Throughout the specification, the term "characteristic chemical bond" is defined according to "Polymer classification" of Materials Database of National Institute for Materials Science (NIMS) (http://polymer.nims.go.jp/PoLyInfo/guide/jp/term_polymer.html). Namely, the "characteristic chemical bonds" include chemical bonds in 22 polymers in total, i.e., polyacrylic, poly-amide, polyacid anhydride, polycarbonate, polydiene, polyester, polyharoolefin, polyimide, polyimine, polyketone, polyolefin, polyether, polyphenylene, polyphosphazene, polysiloxane, polystyrene, polysulfide, polysulfone, polyurethane, polyurea, polyvinyl, and other polymers.

When a resin is a copolymer, the term "similar resins" indicates those resins that have the same characteristic chemical bond in their repeating units of monomer components in the copolymer. Accordingly, resins at least having the same characteristic chemical bond are regarded as similar resins, irrespective of the difference in characteristics of the resins or the molar ratio of the monomer components in the copolymer.

For example, a resin (or resin unit) composed of styrene, butyl acrylate, and acrylic acid and a resin (or resin unit) composed of styrene, butyl acrylate, and methacrylic acid have at least a chemical bond forming polyacrylate, and thus are regarded as similar resins. In another example, a resin (or resin unit) composed of styrene, butyl acrylate, and acrylic acid and a resin (or resin unit) composed of styrene, butyl acrylate, acrylic acid, terephthalic acid and fumaric acid have at least the same chemical bond forming polyacrylate. Accordingly, these are regarded as similar resins.

The amorphous resin unit can be formed of any resin component. Examples of the resin component include vinyl resin units, urethane resin units, and urea resin units. Among these resin units, preferred are vinyl resin units, the thermoplasticity of which can readily be controlled.

Any vinyl resin unit prepared through polymerization of vinyl compounds can be used. Examples thereof include acrylic acid ester resin units, styrene-acrylic acid ester resin units, and ethylene-vinyl acetate resin units. These vinyl resin units may be used alone or in combination.

Among these vinyl resin units, preferred are styrene-acrylic acid ester resin units (styrene-acrylic resin units) in view of plasticity during the thermal fixing process. Accordingly, the styrene-acrylic resin unit as the amorphous resin unit will now be described.

The styrene-acrylic resin unit is prepared through addition polymerization of at least a styrene monomer and a (meth) acrylate ester monomer. The styrene monomer herein includes styrene, represented by the formula $CH_2{=}CH{-}C_6H_5$, and styrene derivatives having known side chains or functional groups in the styrene structures. Examples of the (meth)acrylate ester monomer in the specification include acrylic acid ester and methacrylic acid ester compounds represented by the formula $CH_2{=}CHCOOR$ (where R is an alkyl group), and ester compounds having known side chains or functional groups in the structures of acrylic acid ester or methacrylic acid ester derivatives.

Non-limiting specific examples of the styrene monomers and the (meth)acrylate ester monomers allowing formation of the styrene-acrylic resin unit used in the present invention are listed below.

Specific examples of the styrene monomers include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene. These styrene monomers may be used alone or in combination.

Specific examples of the (meth)acrylate ester monomers include acrylate ester monomers, such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate; and methacrylate esters, such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate.

Throughout the specification, the term "(meth)acrylate ester monomers" collectively indicates "acrylate ester monomers" and "methacrylate ester monomers". For example, "methyl (meth)acrylate" collectively represents "methyl acrylate" and "methyl methacrylate".

These acrylate or methacrylate ester monomers may be used alone or in combination. In other words, the copolymer can be formed with one styrene monomer in combination with two or more acrylate ester monomers, one styrene monomer in combination with two or more methacrylate ester monomers, or one styrene monomer in combination with one acrylate ester monomer and one methacrylate ester monomer.

The content of the structural unit derived from the styrene monomer in the amorphous resin unit is preferably within the range of 40 to 90 mass % of the total amount of the amorphous resin unit. The content of the structural unit derived from the (meth)acrylate ester monomer in the amorphous resin unit is preferably within the range of 10 to 60 mass % of the total amount of the amorphous resin unit. These structural units having contents within such ranges facilitate control of the hybrid resin.

Furthermore, the amorphous resin unit is preferably prepared through addition polymerization of the styrene monomer, the (meth)acrylate ester monomer, and a compound for chemically bonding to the crystalline polyester resin unit. Particularly preferred is use of a compound ester-bonded to the hydroxyl group [—OH] derived from the polyhydric alcohol or the carboxyl group [—COOH] derived from the polyvalent carboxylic acid contained in the crystalline polyester resin unit. Accordingly, the amorphous resin unit is preferably prepared through polymerization of the styrene monomer, the (meth)acrylate ester monomer, and further a compound enabling addition polymerization to the styrene monomer and the (meth)acrylate ester monomer and having a carboxyl group [—COOH] or a hydroxyl group [—OH].

Examples of such a compound include compounds having carboxyl groups, such as acrylic acid, methacrylic acid, maleic acid, itaconic acid, cinnamic acid, fumaric acid, monoalkyl maleate ester, and monoalkyl itaconate ester; and compounds having hydroxyl groups, such as 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, 4-hydroxybutyl (meth)acrylate, and polyethylene glycol mono(meth)acrylate.

The content of the structural unit derived from the compound in the amorphous resin unit is preferably within the range of 0.5 to 20 mass % of the total amount of the amorphous resin unit.

The styrene-acrylic resin unit can be prepared by any method. Examples thereof include a method of polymerizing monomers with a known oil- or water-soluble polymerization initiator. Specific examples of the oil-soluble polymerization initiator include azo or diazo polymerization initiators and peroxide polymerization initiators listed below.

Examples of the azo or diazo polymerization initiators include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

Examples of the peroxide polymerization initiators include benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl)propane, and tris-(t-butylperoxy)triazine.

A water-soluble radical polymerization initiator can be used in preparation of resin particles by emulsion polymerization. Examples of the water-soluble polymerization initiator include persulfates, such as potassium persulfate and ammonium persulfate; azobisaminodipropane acetate; azobiscyanovaleric acid and salts thereof; and hydrogen peroxide.

The content of the amorphous resin unit is preferably 3 mass % or more and less than 15 mass % of the total amount of the hybrid resin. The content is more preferably 5 mass % or more and less than 10 mass %, still more preferably 7 mass % or more and less than 9 mass %.

An amorphous resin unit in a content within this range results in a hybrid resin having sufficient crystallinity.

(Process of Preparing Hybrid Crystalline Polyester Resin (Hybrid Resin))

The hybrid resin contained in the binder resin according to the present invention can be prepared by any process which can prepare a polymer having a structure composed of the crystalline polyester resin unit and the amorphous resin unit molecularly bonded thereto. Specific examples of the process of preparing the hybrid resin include the following processes (1) to (3).

(1) A process of preliminarily preparing an amorphous resin unit through polymerization, and preparing a crystalline polyester resin unit through a polymerization reaction in the presence of the amorphous resin unit to prepare a hybrid resin In this process, the monomers forming the amorphous resin unit (preferably, a styrene monomer and a vinyl monomer, such as a (meth)acrylate ester monomer) are formed into an amorphous resin unit through an addition reaction. A polyvalent carboxylic acid and a polyhydric alcohol are formed into a crystalline polyester resin unit through a polymerization reaction in the presence of the amorphous resin unit. At this time, while a condensation reaction of the polyvalent carboxylic acid and the polyhydric alcohol is being performed, an addition reaction of the polyvalent carboxylic acid or the polyhydric alcohol to the amorphous resin unit is performed to prepare a hybrid resin.

In this process, a site enabling the reaction of the crystalline polyester resin unit and the amorphous resin unit is preferably incorporated into the crystalline polyester resin unit or the amorphous resin unit.

Specifically, the monomers forming the amorphous resin unit and a compound having a site reactive with a carboxy group [—COOH] or a hydroxyl group [—OH] remaining in the crystalline polyester resin unit and a site reactive with the amorphous resin unit are used in preparation of the amorphous resin unit. Namely, this compound can react with the carboxy group [—COOH] or the hydroxyl group [—OH] in the crystalline polyester resin unit to chemically bond the crystalline polyester resin unit to the amorphous resin unit.

Alternatively, a compound having a site reactive with the polyhydric alcohol or the polyvalent carboxylic acid and reactive with the amorphous resin unit can be used in preparation of the crystalline polyester resin unit.

This process can prepare a hybrid resin having a structure (graft structure) composed of the crystalline polyester resin unit molecularly bonded to the amorphous resin unit.

(2) A process of separately preparing a crystalline polyester resin unit and an amorphous resin unit, and bonding these units to prepare a hybrid resin In this process, a polyvalent carboxylic acid and a polyhydric alcohol are formed into a crystalline polyester resin unit through a condensation reaction. Separately from the reaction system for preparing the crystalline polyester resin unit, the monomers forming the amorphous resin unit are formed into an amorphous resin unit through addition polymerization. At this time, a site enabling the reaction of the crystalline polyester resin unit and the amorphous resin unit is preferably incorporated into the crystalline polyester resin unit or the amorphous resin unit. Such a site is incorporated by the process described above, and the redundant description is omitted.

The resulting crystalline polyester unit can be reacted with the amorphous resin unit to prepare a hybrid resin having a structure composed of the crystalline polyester resin unit molecularly bonded to the amorphous resin unit.

If the site enabling the reaction of the crystalline polyester resin unit and the amorphous resin unit is not incorporated into the crystalline polyester resin unit and the amorphous resin unit, a system containing a crystalline polyester resin unit and a co-existing amorphous resin unit may be formed, and a compound having a site enabling bonding of the crystalline polyester resin unit to the amorphous resin unit may be charged into the system. The crystalline polyester resin unit can be molecularly bonded to the amorphous resin unit through the compound to prepare a hybrid resin having the structure described above.

(3) A process of preliminarily preparing a crystalline polyester resin unit, and preparing an amorphous resin unit through a polymerization reaction in the presence of the crystalline polyester resin unit to prepare a hybrid resin In this process, a polyvalent carboxylic acid and a polyhydric alcohol are polymerized through a condensation reaction to prepare a crystalline polyester resin unit. The monomers forming an amorphous resin unit are formed into an amorphous resin unit through a polymerization reaction in the presence of the crystalline polyester resin unit. At this time, as in Process (1), a site enabling the reaction of the crystalline polyester resin unit and the amorphous resin unit is preferably incorporated into the crystalline polyester resin unit or the amorphous resin unit. Such a site is incorporated by the process described above, and the redundant description is omitted.

These processes can prepare a hybrid resin having a structure (graft structure) composed of the amorphous resin unit molecularly bonded to the crystalline polyester resin unit.

Among Processes (1) to (3), preferred is Process (1), which is a simple process and can readily prepare the hybrid resin having a structure composed of the crystalline polyester resin chain grafted to the amorphous resin chain. In Process (1), the amorphous resin unit is preliminarily prepared, and the crystalline polyester resin unit is then bonded to the amorphous resin unit. This process can readily form the crystalline polyester resin unit having uniform orientation. Hence, this process preferably contributes to preparation of a hybrid resin suitable for the toner specified in the present invention.

(Colorants)

The particulate toner contains a colorant according to the present invention. Usable colorants include a variety of known pigments and dyes.

Examples of such carbon black include, for example, channel black, furnace black, acetylene black, thermal black, lamp black and the like. Examples of such black iron oxide include, for example, magnetite, hematite, iron titanium trioxide and the like.

Examples of such dyes include, for example, C. I. Solvent Red 1, C. I. Solvent Red 49, C. I. Solvent Red 52, C. I. Solvent Red 58, C. I. Solvent Red 63, C. I. Solvent Red 111, C. I. Solvent Red 122, C. I. Solvent Yellow 19, C. I. Solvent Yellow 44, C. I. Solvent Yellow 77, C. I. Solvent Yellow 79, C. I. Solvent Yellow 81, C. I. Solvent Yellow 82, C. I. Solvent Yellow 93, C. I. Solvent Yellow 98, C. I. Solvent Yellow 103, C. I. Solvent Yellow 104, C. I. Solvent Yellow 112, C. I. Solvent Yellow 162, C. I. Solvent Blue 25, C. I. Solvent Blue 36, C. I. Solvent Blue 60, C. I. Solvent Blue 70, C. I. Solvent Blue 93, C. I. Solvent Blue 95 and the like.

Examples of such pigments include, for example, C. I. Pigment Red 5, C. I. Pigment Red 48:1, C. I. Pigment Red 48:3, C. I. Pigment Red 53:1, C. I. Pigment Red 57:1, C. I. Pigment Red 81:4, C. I. Pigment Red 122, C. I. Pigment Red 139, C. I. Pigment Red 144, C. I. Pigment Red 149, C. I. Pigment Red 150, C. I. Pigment Red 166, C. I. Pigment Red 177, C. I. Pigment Red 178, C. I. Pigment Red 222, C. I. Pigment Red 238, C. I. Pigment Red 269, C. I. Pigment Orange 31, C. I. Pigment Orange 43, C. I. Pigment Yellow 14, C. I. Pigment Yellow 17, C. I. Pigment Yellow 74, C. I. Pigment Yellow 93, C. I. Pigment Yellow 94, C. I. Pigment Yellow 138, C. I. Pigment Yellow 155, C. I. Pigment Yellow 156, C. I. Pigment Yellow 158, C. I. Pigment Yellow 180, C. I. Pigment Yellow 185, C. I. Pigment Green 7, C. I. Pigment Blue 15:3, C. I. Pigment Blue 60 and the like.

These coloring agents may be used alone or in combination of two or more for producing the respective color toners.

The content of the coloring agent in the particulate toner is preferably from 1 mass % to 10 mass %, more preferably from 2 mass % to 8 mass %. The colorant used in a content within this range results in a toner having a desired coloring ability, and can minimize influences on charging properties, which are caused by the colorant detached from the particulate toner or adhering to the carrier.

(Mold Release Agent)

In the toner for developing electrostatic latent images according to the present invention, the particulate toner may contain a mold release agent. The mold release agent contained in the particulate toner has low miscibility with the crystalline polyester resin contained in the particulate toner, and readily bleeds out to the surfaces of the particulate toner during the thermal fixing process, resulting in high fixing separation characteristics of the particulate toner.

The mold release agent is dispersed as a domain phase in a matrix phase. The domain phase has an average diameter of 0.05 to 2 μm, for example. The average diameter of the domain phase is determined from a transmission electron microscopic (TEM) image. Specifically, in the TEM image, the diameter of each domain phase is defined as the average of the horizontal Feret diameter and the vertical Feret diameter, and the average of the diameters of the domain phases is determined as the average diameter of the domain phase through calculation.

For the releasing agent, a variety of waxes known in the art may be used.

Waxes that can be suitably used include polyolefin waxes such as low-molecular weight polypropylene, polyethylene, oxidized polypropylene and polyethylene, ester waxes such as behenyl behenate, and the like.

Examples of such waxes include, for example, polyolefin waxes such as a polyethylene wax and a polypropylene wax; branched chain hydrocarbon waxes such as a microcrystalline wax; long chain hydrocarbon waxes such as a paraffin wax and SASOLWAX, dialkylketone waxes such as distearylketone, ester waxes such as carnauba wax, montan wax, behenyl behenate, trimethylolpropane tribehenate, pentaerythritol tetrabehenate, pentaerythritol diacetate behenate, glycerin tribehenate, 1,18-octadecanediol distearate, tristearyl trimellitate and distearyl maleate; amide waxes such as ethylenediamine behenylamide and trimellitic tristearylamide, and the like.

Among the above-described compounds, those having a low melting point, specifically having a melting point of 40° C. to 90° C. are preferably used in terms of the releasing property in low-temperature fixing.

The content of the releasing agent in the particulate toner is preferably from 0.5 to 10 mass %, more preferably from 3 to 7 mass %.

Although the proportion of the mold release agent contained in the particulate toner is lower than that of the molding release agent in the traditional toners as specified above, the mold release agent has low miscibility with the crystalline polyester resin contained in the particulate toner. For this reason, the mold release agent readily bleeds out to the surfaces of the particulate toner, resulting in high fixing separation characteristics of the particulate toner.

(Charge Control Agent)

In the toner for developing electrostatic latent images according to the present invention, the particulate toner preferably contains a charge control agent. Usable charge control agents include a variety of known compounds.

The proportion of the charge control agent is preferably within the range of 0 to 5 mass %, more preferably 0 to 0.5 mass % of the particulate toner.

(External Additive)

In the toner for developing electrostatic latent images according to the present invention, the particulate toner can be directly used as the toner. However, in order to improve the fluidity, charging characteristics, cleaning property and the like, an external additive such as a so-called fluidizer and a cleaning aid may be added to the particulate toner. A variety of compounds may be used in combination as the external additive.

Such external additives are added in a total amount of preferably 0.05 parts by mass to 5 parts by mass, more preferably 0.1 parts by mass to 3 parts by mass with respect to 100 parts by mass of the particulate toner.

(Glass Transition Temperature of Toner)

The toner for developing electrostatic latent images according to the present invention has a glass transition temperature (Tg) within the range of preferably 50 to 70° C., more preferably 55 to 65° C.

The toner for developing electrostatic latent images according to the present invention having a glass transition temperature within this range certainly has compatibility between sufficient low-temperature fixing characteristics and heat resistance during storage. It is believed that the toner having a glass transition temperature within this range maintains its heat resistance (thermal strength). Hence, sufficient heat resistance during storage and hot offset resistance are certainly attained.

(Melting Point of Toner)

The toner for developing electrostatic latent images according to the present invention has a melting point (Tm) within the range of preferably 60 to 90° C., more preferably 65 to 80° C.

The toner for developing electrostatic latent images according to the present invention having a melting point within this range certainly has compatibility between sufficient low-temperature fixing characteristics and heat resistance during storage. It is believed that the toner having a melting point within this range preferably maintains its heat resistance (thermal strength). As a result, sufficient heat resistance during storage can also be ensured.

The glass transition temperature and the melting point of the toner are determined as in the crystalline polyester resin.

(Particle Size of Toner)

In the toner for developing electrostatic latent images according to the present invention, the average particle size given as a volume median particle size is within the range of preferably 3 to 8 μm, more preferably 5 to 8 μm. The average particle size can be controlled by the concentration of a flocculant to be used, the amount of an organic solvent to be added, the fusing time and/or the composition of the binder resin.

The particulate toner having a volume median particle size within this range enable close reproduction of super-fine dot images in order of 1200 dpi.

The volume median particle size of the toner is measured and calculated by using a measuring equipment composed of "MULTISIZER 3" (Beckman Coulter Inc.) and a computer system installed with a data processing software "SOFTWARE V3.51" connected thereto.

Specifically, 0.02 g of a sample (toner) is added to 20 mL of a surfactant solution (for dispersing the particulate toner, e.g. a surfactant solution prepared by eluting a neutral detergent containing a surfactant component with purified water by 10 times) and is allowed to be uniform, and then the solution is subjected to ultrasonic dispersion for 1 minute. The toner dispersion thus prepared is added to "ISOTON II" (Beckman Coulter Inc.) in a beaker placed in sample stand by a pitette until the concentration displayed on the measuring equipment reaches 8%. Within this concentration range, reproducible measurement values can be obtained.

The measuring particle count and the aperture size of the measuring equipment are set to 25000 and 100 μm respectively. The measuring range, which is from 2 μm to 60 μm, is divided into 256 sections to calculate the respective frequencies. The particle size where the accumulated volume counted from the largest size reaches 50% is determined as the volume median particle size.

(Average Circularity of Toner)

In the toner of the present invention, it is preferred that the particulate toner have an average circularity of 0.930 to 1.000, more preferably 0.950 to 0.995 in terms of the stability of the charging characteristics and the low-temperature fixability.

When the average circularity is within the above-described range, the individual toner particles are less crushable. This prevents the triboelectric charge applying member from smudges and stabilizes the charging characteristics of the toners. Further, high quality images can be formed.

The average circularity of the toner is measured by "FPIA-2100" (Sysmex Corp.).

Specifically, a sample (toner) is mixed with an aqueous solution containing a surfactant and is further dispersed by ultrasonication for 1 minute. Thereafter, photographs are taken by means of "FPIA-2100" (Sysmex Corp.) in the conditions of the HPF (high power imaging) mode at an adequate concentration range corresponding to an HPF detect number of 3000 to 10000. The average circularity of the toner is calculated by determining the circularity of each toner particle according to the following Equation (y) and dividing the sum of the circularities of the toner particles by the total number of toner particles. The HPF detect number within the above range achieves reproducibility.

$$\text{Circularity}=(\text{Circumference of circle having same area as projected image of particle})/(\text{Perimeter of projected image of particle}) \quad \text{Equation (y):}$$

(Developer)

The toner for developing electrostatic latent images according to the present invention can be used as a magnetic or non-magnetic one-component developer, or can be used as a two-component developer in the form of a mixture with a carrier.

The carrier usable in the toner as a two-component developer is composed of magnetic particles of a conventional known material, such as a metal (such as iron, ferrite, or magnetite), or an alloy of the metal and another metal (such as aluminum or lead). Particularly preferred are ferrite particles.

The carrier can be a coated carrier composed of magnetic particles having surfaces coated with a coating agent, such as a resin, or a carrier of a dispersion type composed of magnetic nanoparticles dispersed in a binder resin.

The average particle size of the carrier given as a volume median particle size is within the range of preferably 20 to 100 μm, more preferably 25 to 80 μm.

The volume median particle size of the carrier can be typically determined with a laser diffraction particle diameter distribution analyzer HELOS (available from SYMPATEC GmbH) provided with a wet disperser.

<<Process of Preparing Toner>>

Examples of the process of preparing a toner include a wet process of preparing a toner in an aqueous medium, such as emulsion aggregation.

In preparation of the toner by emulsion aggregation, for example, nanoparticles of a binder resin (hereinafter, also referred to as "binder resin nanoparticles") are dispersed in an aqueous medium to prepare an aqueous dispersion, and nanoparticles of a colorant (hereinafter, also referred to as "colorant nanoparticles") are dispersed in an aqueous medium to prepare an aqueous dispersion. These aqueous dispersions are mixed. The binder resin nanoparticles and the colorant nanoparticles are aggregated, and are thermally fused to form a particulate toner. A toner is thereby prepared.

An exemplary process of preparing a toner involves the following steps:

(a) a step of preparing Particulate toner precursor (I), (b) a step of preparing Particulate toner precursor (II), (c) a step of preparing Particulate toner precursor (III), (d) a step of dispersing nanoparticles of a crystalline polyester resin (hereinafter, also referred to as "crystalline polyester resin nanoparticles") in an aqueous medium to prepare an aqueous dispersion, (e) a step of dispersing colorant nanoparticles in an aqueous medium to prepare an aqueous dispersion, (f) a step of forming a particulate toner, (g) a step of cooling the dispersion of the particulate toner, (h) a step of separating the particulate toner from the aqueous medium through filtration to remove a surfactant from the particulate toner, (i) a step of drying the cleaned particulate toner, and (j) an optional step of adding an external additive to the dry particulate toner.

Throughout the specification, the term "aqueous dispersion" indicates a state of a nanoparticulate substance dispersed in an aqueous medium, and the aqueous medium indicates a medium containing mainly (50 mass % or more) water.

Examples of the components other than water include water-soluble organic solvents, such as methanol, ethanol, isopropanol, butanol, acetone, methyl ethyl ketone, and tetrahydrofuran. Among these organic solvents, particularly preferred are alcoholic organic solvents, such as methanol, ethanol, isopropanol, and butanol, which do not dissolve resins.

(a) Preparation of Particulate Toner Precursor (I) (First Polymerization)

In this step, Particulate toner precursor (I) is prepared through emulsion polymerization according to a standard method.

Specifically, a polymerization initiator is added to a surfactant solution, and the solution is heated. While the solution is being stirred, a polymerizable monomer solution is added dropwise to perform a reaction.

The reaction temperature is preferably within the range of 70 to 90° C., for example.

The average particle size of Particulate toner precursor (I) given as a volume median particle size is preferably within the range of 50 to 150 nm. The volume median particle size of the particulate toner precursor is determined with UPA-150 (made by Microtrac, Inc.).

(b) Preparation of Particulate Toner Precursor (II) (Second Polymerization)

In this step, a polymerizable monomer containing a polymerization initiator and a mold release agent is added to the dispersion of Particulate toner precursor (I) prepared through first polymerization to prepare Particulate toner precursor (II).

Specifically, a surfactant solution is added to a mixed solution of the dispersion of Particulate toner precursor (I). The resulting solution and a polymerizable monomer containing a mold release agent dissolved therein are heated, and are dispersed by mixing with a mechanical disperser. A polymerization initiator is added, and the solution is polymerized by stirring under heating.

The amount of the aqueous medium used for dispersion of Particulate toner precursor (I) is preferably within the range of 5 to 50 parts by mass of the total solvent used in second polymerization to produce a toner maintaining compatibility between elasticity at high temperature and low-temperature fixing characteristics.

The reaction temperature is preferably within the range of 70 to 95° C., for example.

(c) Preparation of Particulate Toner Precursor (III) (Third Polymerization)

In this step, a polymerizable monomer is added to the dispersion of Particulate toner precursor (II) prepared through second polymerization to prepare Particulate toner precursor (III).

Specifically, a polymerization initiator is added to a heated dispersion of Particulate toner precursor (II). A polymerizable monomer is added dropwise under heating to perform polymerization.

The reaction temperature is preferably within the range of 70 to 95° C., for example.

(d) Preparation of Aqueous Dispersion of Crystalline Polyester Resin Nanoparticles In this step, a crystalline polyester resin is used to prepare an aqueous dispersion of crystalline polyester resin nanoparticles.

A crystalline polyester resin is synthesized, and is dispersed in an aqueous medium in the form of nanoparticles to prepare an aqueous dispersion of crystalline polyester resin nanoparticles.

A typical process of dispersing the crystalline polyester resin in the aqueous medium involves dissolving or dispersing the crystalline polyester resin in an organic solvent to prepare an oil phase solution or dispersion, dispersing the oil phase solution or dispersion in an aqueous medium through phase inversion emulsification or the like to prepare oil droplets having a desired size, and removing the organic solvent.

The aqueous medium is preferably used in an amount within the range of 50 to 2000 parts by mass, more preferably 100 to 1000 parts by mass relative to 100 parts by mass of the oil phase solution or dispersion.

A surfactant may be added to the aqueous medium to enhance the dispersion stability of the oil droplets. Usable surfactants include a variety of known anionic, cationic, and non-ionic surfactants.

Preferred organic solvents used in preparation of the oil phase solution or dispersion are those having low boiling points and low solubilities in water because such organic solvents are readily removed after preparation of oil droplets. Specific examples of such organic solvents include methyl acetate, ethyl acetate, methyl ethyl ketone, methyl isobutyl ketone, toluene, and xylene. These organic solvents can be used alone or in combination. The amount of the organic solvent used is within the range of usually 1 to 300 parts by mass, preferably 1 to 100 parts by mass, more preferably 25 to 70 parts by mass relative to 100 parts by mass of the crystalline polyester resin.

The oil phase solution or dispersion can be emulsified by mechanical energy in any disperser. Examples of the disperser include low speed shear dispersers, high speed shear dispersers, frictional dispersers, high pressure jet dispersers, and ultrasonic dispersers, such as TK HOMOMIXER (made by Tokushu Kika Kogyo Co., Ltd.).

The oil droplets dispersed has a diameter within the range of preferably 60 to 1000 nm, more preferably 80 to 500 nm.

The diameter of oil droplets dispersed indicates a volume median particle size determined with a laser diffraction/scattering particle size distribution analyzer LA-750 (made by HORIBA, Ltd.). The diameter of oil droplets dispersed can be controlled through the adjustment of mechanical energy during emulsion by dispersion.

The average particle size of the crystalline polyester resin nanoparticles given as a volume median particle size is preferably within the range of 50 to 500 nm.

The volume median particle size of the crystalline polyester resin nanoparticles is determined with MICROTRAC UPA-150 (made by NIKKISO CO., LTD.).

e) Step of Preparing Aqueous Colorant Nanoparticle Dispersion

This step is performed when necessary in preparation of particulate toner containing a colorant. A colorant is dispersed in an aqueous medium in the form of nanoparticles to prepare an aqueous colorant nanoparticle dispersion.

The aqueous colorant nanoparticle dispersion is prepared by dispersing a colorant in an aqueous medium containing a surfactant in the critical micelle concentration (CMC) or more.

The colorant can be dispersed by mechanical energy in any disperser. Preferred examples of the disperser include ultrasonic dispersers; mechanical homogenizers; pressurized dispersers, such as MANTON-GAULIN homogenizers and pressurized homogenizers; and medium dispersers, such as sand grinders, GETSMAN mills, and DIAMOND fine mills.

The colorant nanoparticles dispersed has a volume median particle size within the range of preferably 10 to 300 nm, more preferably 100 to 200 nm, particularly preferably 100 to 150 nm.

The volume median particle size of the colorant nanoparticles is determined with an electrophoretic light scattering photometer ELS-800 (made by Otsuka Electronics Co., Ltd.).

(f) Formation of Particulate Toner

In this step, the crystalline polyester resin nanoparticles and the colorant nanoparticles are precipitated on the surface of Particulate toner precursor (III) prepared through third polymerization, and are fused by heating to form a particulate toner.

Specifically, Particulate toner precursor (III), the crystalline polyester resin nanoparticles, and the colorant nanoparticles are dispersed in an aqueous medium to prepare an aqueous dispersion, and a flocculant is added to the aqueous dispersion in the critical precipitation concentration or more. The mixed solution is heated to precipitate and fuse these nanoparticles.

The fusing temperature is preferably within the range of 70 to 95° C., for example.

(Coagulant)

The coagulant used may be any coagulant but is preferably selected from metal salts, such as salts of alkaline metals or alkaline earth metals.

Such metal salts include, for example, monovalent metal salts such as sodium, potassium and lithium; divalent metal salts such as salts of calcium, magnesium, manganese and copper; trivalent metal salts such as salts of iron and aluminum; and the like.

Specific examples of such metal salts include sodium chloride, potassium chloride, lithium chloride, calcium chloride, magnesium chloride, zinc chloride, copper sulfate, magnesium sulfate, manganese sulfate and the like. Among them, divalent metal salts are particularly preferred since the aggregation is caused by a smaller amount. These coagulants may be used alone or in combination.

The process of preparing a toner preferably involves the step of forming a particulate toner and an aging step.

In the aging step, the particulate toner prepared through the step of forming a particulate toner is aged by thermal energy until a desired shape is obtained.

Specifically, the system including the particulate toner dispersed is stirred under heating to age the particulate toner until the particulate toner has a desired circularity, while the heating temperature, the stirring rate, and the heating time are being controlled.

(g) Cooling

In this step, the dispersion of the particulate toner is cooled.

This cooling step is preferably performed at a cooling rate of 1 to 20° C./min. The cooling can be performed by any method, for example, a method of introducing a coolant into a reaction container to cool the dispersion of particulate toner, or a method of directly feeding cooling water to a reaction system to cool the dispersion of the particulate toner.

(h) Filtration and Cleaning

In this step, the particulate toner is subjected to solid liquid separation from the cooled dispersion of the particulate toner, and adhering substances, such as a surfactant and a flocculant, are removed from the toner cake extracted through solid liquid separation (wet particulate toner agglomerated in the form of a cake) to clean the toner cake.

Solid liquid separation can be performed by any method, such as filtration under reduced pressure through centrifugation or a suction funnel or filtration with a filter press. In cleaning, the toner cake is preferably washed with water until the electric conductivity of the filtrate decreases to 10 μS/cm.

(i) Drying

In this step, the cleaned toner cake is dried by a drying step usually performed in a known process of preparing a particulate toner.

Specific examples of a dryer used for drying of the toner cake include spray dryers, vacuum freeze dryers, and reduced pressure dryers. Preferred is use of dryers with fixed shelfs, dryers with movable shelfs, fluid layer dryers, rotary dryers, and stirring dryers.

The moisture content of the dry particulate toner is preferably 5 mass % or less, more preferably 2 mass % or less. The dry particulate toner agglomerated with a weak interparticle attractive force may be disintegrated. Usable disintegrators include mechanical crushers, such as jet mills, Henschel mixers, coffee mills, and food processors.

(j) Addition of External Additive

In this optional step, an external additive is added to the particulate toner.

The particulate toner described above can be used as a toner as they are. The particulate toner may contain external additives, such as a fluidizing agent and a cleaning aid to have enhanced fluidity, charging characteristics, and cleaning characteristics.

A variety of external additives can be used in combination.

These external additives are added in a total amount within the range of preferably 0.05 to 5 parts by mass, more preferably 0.1 to 3 parts by mass relative to 100 parts by mass of the particulate toner.

The external additives can be mixed with the particulate toner in a mechanical mixer, such as a HENSCHEL MIXER or a coffee mill.

The particulate toner according to the present invention may further contain an amorphous polyester resin. Containing an amorphous polyester resin contributes to excellent heat-resistant storage characteristics. In addition, being miscible with the crystalline polyester resin contributes to low-temperature fixing characteristics.

EXAMPLES

The present invention will now be described in detail by way of non-limiting Examples. In Examples, "parts" and "%" are on the mass basis, unless otherwise specified.

A process of preparing Toner 1 will now be described in detail.

<<Preparation of Toner 1>>

[Preparation of Resin Particle Dispersion (A)]

<First Polymerization (Preparation of Dispersion of Particulate Toner Precursor (I))>

An anionic surfactant sodium lauryl sulfate (2.0 parts by mass) was dissolved in deionized water (2900 parts by mass) to prepare an anionic surfactant solution, and the anionic surfactant solution was placed into a reaction container provided with a stirrer, a temperature sensor, a temperature controller, a cooling tube, and a nitrogen inlet. While the anionic surfactant solution was being stirred at a stirring rate of 230 rpm under a nitrogen stream, the internal temperature of the reaction container was heated to 80° C.

A polymerization initiator potassium persulfate (KPS) (9.0 parts by mass) was added to this surfactant solution, and the internal temperature was raised to 78° C. Monomer solution (1) having the following composition was added dropwise over three hours. After addition was completed, the solution was stirred while being heated at 78° C. for one hour to perform polymerization (first polymerization). A dispersion of Particulate toner precursor (I) was thereby prepared.

Monomer Solution (1)

| | |
|---|---|
| Styrene | 540 parts by mass |
| n-Butyl acrylate | 270 parts by mass |
| Methacrylic acid | 65 parts by mass |
| n-Octylmercaptan | 17 parts by mass |

<Second Polymerization: Preparation of Dispersion of Particulate Toner Precursor (II)>

Into a flask provided with a stirrer, placed was Monomer solution (2) having the following composition. An ester wax (melting point: 73° C.) (51 parts by mass) as a mold release agent was then added, and was dissolved at 85° C. to prepare Wax dissolution (1).

Monomer Solution (2)

| | |
|---|---|
| Styrene | 94 parts by mass |
| n-Butyl acrylate | 60 parts by mass |
| Methacrylic acid | 11 parts by mass |
| n-Octylmercaptan | 5 parts by mass |

An anionic surfactant sodium lauryl sulfate (2 parts by mass) was dissolved in deionized water (1100 parts by mass) to prepare a surfactant solution. The surfactant solution was heated to 90° C. The dispersion of Particulate toner precursor (I) was added to the surfactant solution in an amount of 28 parts by mass in terms of the solid content of Particulate toner precursor (I).

Wax dissolution (1) was dispersed by mixing in a mechanical disperser CLEAMIX (made by M Technique Co., Ltd.) having a circulation path for one hour to prepare a dispersion containing emulsified particles having a diameter of 350 nm. An initiator aqueous solution of a polymerization initiator KPS (2.5 parts by mass) in deionized water (110 parts by mass) was added to the dispersion.

This system was stirred at 90° C. for two hours to perform polymerization (second polymerization) to prepare a dispersion of Particulate toner precursor (II).

<Preparation of Particulate Toner Precursor (III)>

An initiator aqueous solution of a polymerization initiator KPS (2.5 parts by mass) in deionized water (110 parts by mass) was added to the dispersion of Particulate toner precursor (II). Monomer solution (3) having the following composition was added dropwise to the solution at 80° C. over one hour. After addition was completed, the solution was stirred under heating for three hours to perform polymerization (third polymerization).

Monomer Solution (3)

| | |
|---|---|
| Styrene | 230 parts by mass |
| n-Butyl acrylate | 100 parts by mass |
| n-Octylmercaptan | 5 parts by mass |

The reaction solution was cooled to 28° C. to prepare a dispersion of Particulate toner precursor (III) in the anionic surfactant solution, Particulate toner precursor (III) containing a styrene-acrylic resin.

The molecular weight was determined by the method described later. Dry Particulate toner precursor (III) had a weight average molecular weight (Mw) of 38200 and a number average molecular weight (Mn) of 11500.

[Synthetic Example of Crystalline Polyester Resin]

Raw material monomers for an addition polymerization resin (i.e., styrene and butyl acrylate), a monomer reactive with styrene and butyl acrylate (i.e., acrylic acid), and a radical polymerization initiator shown below were placed in a dropping funnel.

| | |
|---|---|
| Styrene | 35 parts by mass |
| Butyl acrylate | 9 parts by mass |
| Acrylic acid | 4 parts by mass |
| Radical polymerization initiator (di-t-butyl peroxide) | 7 parts by mass |

The following raw material monomers for a polycondensation resin were placed in a four-necked flask provided with a nitrogen inlet, a dehydration pipe, a stirrer, and a thermocouple, and were dissolved while being heated at 170° C.

| | |
|---|---|
| Sebacic acid | 278 parts by mass |
| Dodecanediol | 280 parts by mass |

The raw material monomers for an addition polymerization resin were added dropwise with stirring over 90 minutes, and were aged for 60 minutes. A non-reacted addition polymerization monomer was removed under reduced pressure (8 kPa).

An esterification catalyst $Ti(OBu)_4$ (0.8 parts by mass) was added, and the system was heated to 235° C. to perform a reaction under normal pressure (101.3 kPa) for five hours, followed by a reaction under reduced pressure (8 kPa) for one hour.

The system was cooled to 200° C., and a reaction was performed under reduced pressure (20 kPa) for one hour to prepare Crystalline polyester resin [a]. Crystalline polyester resin [a] had a number average molecular weight (Mn) of 8500 and a melting point of 77° C.

[Preparation Example of Aqueous Dispersion [A] of Crystalline Polyester Resin Nanoparticles]

A melted crystalline polyester resin (30 parts by mass) was fed to an emulsion disperser CAVITRON CD1010 (made by Eurotec, Ltd.) at a feeding rate of 100 parts by mass/min.

While the melted crystalline polyester resin was being fed, 0.37 mass % diluted aqueous ammonia prepared by diluting reagent-grade aqueous ammonia (70 parts by mass) with deionized water in an aqueous solvent tank was fed to the emulsion disperser at a feeding rate of 0.1 L/min while being heated to 100° C. with a heat exchanger.

The emulsion disperser was operated at a rotational speed of a rotor of 60 Hz and a pressure of 5 $kg/cm^2$ to prepare Aqueous dispersion [a] of crystalline polyester resin nanoparticles having a volume median particle size of 200 nm (solid content: 30 parts by mass).

[Preparative Example of Aqueous Colorant Nanoparticle Dispersion [Cy]]

Sodium dodecyl sulfate (90 parts by mass) was added to deionized water (1600 parts by mass). While the solution was being stirred, copper phthalocyanine (420 parts by mass) was gradually added, and was dispersed with a stirrer CLEAMIX (made by M Technique Co., Ltd.) to prepare Aqueous colorant nanoparticle dispersion [Cy].

In Aqueous colorant nanoparticle dispersion [Cy], the colorant nanoparticles had an average particle size (volume median particle size) of 110 nm.

[Preparation of Toner 1]

Dispersion of Particulate toner precursor (III) (195 parts by mass in terms of the solid content), Aqueous dispersion [a] of crystalline polyester resin nanoparticles (30 parts by mass in terms of the solid content), and deionized water (2000 parts by mass) were placed in a reaction container provided with a stirrer, a temperature sensor, and a cooling tube, and an aqueous solution of 5 mol/L sodium hydroxide was added to adjust the pH to 10.

Aqueous colorant nanoparticle dispersion [Cy] (40 parts by mass in terms of the solid content) was added, and an aqueous solution of magnesium chloride (60 parts by mass) in deionized water (60 parts by mass) was added with stirring at 30° C. over 10 minutes.

This system was heated to 80° C. for 60 minutes, and Aqueous dispersion [a] of hybrid crystalline polyester resin nanoparticles was added over 10 minutes. During this operation, the particle sizes of associated particles were determined with a particle size analyzer COULTER MULTISIZER 3 (made by Beckman Coulter, Inc.). When the volume median particle size reached 6.0 μm, an aqueous solution of sodium chloride (190 parts by mass) in deionized water (760 parts by mass) was added to terminate the growth of the particles.

The system was further heated, and was stirred under heating at 80° C. to progress fusing of the particles. When the average circularity of the toner determined with FPIA-2100 (made by Sysmex Corporation) (4000 particles detected in a high-power field (HPF)) was 0.945, the system was cooled to 30° C. at a cooling rate of 2.5° C./min.

Solid liquid separation was then performed, and the dehydrated toner cake was redispersed in deionized water. This operation of solid liquid separation was repeated three times. The product was dried at 40° C. for 24 hours to prepare Cyan toner particles [1X].

Hydrophobic silica (number average primary particle diameter=12 nm, degree of hydrophobization=68) (0.6 parts by mass) and hydrophobic titanium oxide (number average primary particle diameter=20 nm, degree of hydrophobization=63) (1.0 part by mass) were added to Cyan toner particles [1X] (100 parts by mass), and were mixed with a HENSCHEL MIXER (made by Mitsui Miike Kakoki K.K.) at a circumferential velocity of a rotary blade of 35 mm/sec and 32° C. for 20 minutes. Coarse particles were removed with a sieve having an opening of 45 μm. External additives were thereby applied to the toner particles to prepare Toner 1.

A ferrite carrier coated with a silicone resin and having a volume average particle size of 60 μm was added to Toner 1 such that the toner content was 6 mass %, and was mixed with Toner 1 to prepare Developer 1.

<<Preparation of Toners 2 to 13 and 15 to 17>>

Resin particle dispersions (A) to (I) were prepared as in Toner 1 on the conditions shown in Table 1.

TABLE 1

| Types of resin particle dispersion | First polymerization: Potassium persulfate [Parts by mass] | First polymerization: n-Octylmercaptan [Parts by mass] | Amount of resin particle dispersion in first polymerization [Parts by mass] | Molecular weight of resin particles: Mw ($\times 10^4$) | Molecular weight of resin particles: Mn ($\times 10^4$) |
|---|---|---|---|---|---|
| A | 9 | 17 | 28 | 3.82 | 1.15 |
| B | 3 | 0 | 42 | 5.71 | 0.99 |
| C | 18 | 34 | 20 | 2.99 | 1.42 |
| D | 15 | 40 | 20 | 3.04 | 1.58 |
| E | 3 | 0 | 45 | 5.88 | 0.95 |
| F | 9 | 17 | 50 | 7.72 | 3.11 |
| G | 9 | 17 | 18 | 2.68 | 1.30 |
| H | 3 | 0 | 70 | 9.72 | 1.69 |
| I | 15 | 40 | 2 | 1.47 | 0.75 |

Crystalline polyester resin dispersions (a) to (g) were prepared as in Toner 1 on the conditions shown in Table 2.

TABLE 2

| Types of crystalline polyester resin | Content of vinyl polymerizable monomer [%] | Acid value [mgKOH/g] | Molecular weight: Mw ($\times 10^4$) | Molecular weight: Mn ($\times 10^4$) |
|---|---|---|---|---|
| a | 10 | 10 | 2.28 | 0.85 |
| b | 0 | 10 | 1.91 | 0.69 |
| c | 30 | 10 | 2.85 | 1.10 |
| d | 35 | 10 | 3.04 | 1.25 |
| e | 10 | 5 | 3.38 | 1.34 |
| f | 10 | 30 | 1.66 | 0.58 |
| g | 10 | 35 | 1.49 | 0.51 |

Toners 2 to 13 and 15 to 17 were prepared as in Toner 1. The physical properties of the toners are shown in Table 3.

<<Preparation of Toner 14>>

[Preparation of Resin Particle Dispersion (M)]

Terephthalic acid (TPA) (85 parts by mass), trimellitic acid (TMA) (6 parts by mass), fumaric acid (FA) (18 parts by mass), dodecenylsuccinic anhydride (DDSA) (80 parts by mass), a bisphenol A propylene oxide adduct (BPA•PO) (335 parts by mass), and a bisphenol A ethylene oxide adduct (BPA•EO) (55 parts by mass) were placed in a reaction container provided with a stirrer, a thermometer, a cooling tube, and a nitrogen gas inlet, and the inside of the reaction container was purged with dry nitrogen gas. Titanium tetrabutoxide (0.1 parts by mass) was added, and a polymerization reaction was performed under a nitrogen gas stream with stirring at 180° C. for eight hours.

Titanium tetrabutoxide (0.2 parts by mass) was further added, and the polymerization reaction was performed with stirring at 220° C. for six hours. The internal pressure of the reaction container was reduced to 10 mmHg, and the reaction was performed under reduced pressure for two hours to prepare transparent light-yellow Amorphous resin [1].

The weight average molecular weight (Mw) of Amorphous resin [1] was 32000.

The glass transition temperature (Tg) of the amorphous resin was determined by differential scanning calorimetry (DSC). Amorphous resin (3.0 mg) was sealed in an aluminum pan, and the aluminum pan was placed on a sample holder of a differential scanning calorimeter Diamond DSC (made by PerkinElmer Inc.).

The temperature of the aluminum pan was controlled through a series of operation of first heating from room temperature to 150° C. at a heating rate of 10° C./min and holding at 150° C. for five minutes, cooling from 150° C. to 0° C. at a cooling rate of 10° C./min and holding at 0° C. for five minutes, and second heating from room temperature to 150° C. at a heating rate of 10° C./min. The on-set temperature in the DSC curve of the second heating was defined as the glass transition temperature.

An empty aluminum pan was used as a reference. The glass transition temperature (Tg) of Amorphous resin [1] was 59° C.

Amorphous resin [1] (200 parts by mass) was dissolved in ethyl acetate (200 parts by mass), and was mixed with an aqueous solution of 1 mass % sodium polyoxyethylene lauryl ether sulfate in deionized water (800 parts by mass). The mixture was dispersed with an ultrasonic homogenizer.

The resulting emulsion (1200 parts by mass) was placed in a 2-L eggplant flask, and the flask was placed on an evaporator provided with a vacuum controller (made by TOKYO RIKAKIKAI CO., LTD.) through a trap.

While the eggplant flask was being rotated, the eggplant flask was heated in a hot bath at 60° C. The solvent was removed while the pressure was reduced to 7 kPa so as not to cause bumping. After 400 parts by mass of the solvent was recovered, the pressure was returned to normal pressure, and the eggplant flask was cooled with water to prepare a dispersion. Deionized water was added to the dispersion to adjust such that the solid content was 20 mass %. Resin nanoparticle dispersion (M) of nanoparticles of Amorphous resin [1] in the aqueous medium was thereby prepared.

The volume median particle size of the nanoparticles of Amorphous resin [1] was 230 nm. The median particle size was determined with a particle size distribution analyzer UPA-150 (made by NIKKISO CO., LTD.).

[Preparation of Mold Release Agent Nanoparticle Dispersion]

A mold release agent (Fischer-Tropsch wax FNP-0090, melting point: 89° C., made by NIPPON SEIRO CO., LTD.) (200 parts by mass) was heated to 95° C. to be dissolved. The resulting solution was placed in a surfactant aqueous solution of 3 mass % sodium alkyl diphenyl ether disulfonate in deionized water (800 parts by mass), and was dispersed with an ultrasonic homogenizer. The solid content was adjusted to 20 mass %. A dispersion of mold release agent nanoparticles in an aqueous medium was thereby prepared.

The volume median particle size of the mold release agent nanoparticles in the dispersion was determined with a particle size distribution analyzer UPA-150 (made by NIKKISO CO., LTD.). The mold release agent nanoparticles had a volume median particle size of 190 nm.

[Preparation of Toner 14]

Resin nanoparticle dispersion (M) (583 parts by mass), the crystalline resin nanoparticle dispersion (70 parts by mass), the mold release agent nanoparticle dispersion (85 parts by mass), the colorant nanoparticle dispersion (62 parts by mass), and an aqueous solution of sodium polyoxyethylene lauryl ether sulfate (0.5 parts by mass) were placed in a reaction container provided with a stirrer, a cooling tube, and a thermometer. While these materials were being stirred, 0.1 N hydrochloric acid was added to adjust the pH to 2.5 at 25° C.

An aqueous solution of poly(aluminum chloride) (10% aqueous solution in terms of $AlCl_3$) (0.4 parts by mass) was added dropwise over ten minutes. The solution was heated at a rate of 0.05° C./min with stirring, and the particle sizes of the aggregated particles were appropriately determined with a particle size analyzer COULTER MULTISIZER 3 (made by Beckman Coulter, Inc.).

When the volume median particle size of the agglomerated particles reached 5.0 μm, heating was stopped, and Resin nanoparticle dispersion (M) (222.2 parts by mass) for forming shells was added dropwise over one hour.

The pH of the system was then adjusted to 8.5 (25° C.) with an aqueous solution of 0.5 N sodium hydroxide to terminate the growth of particles. The system was heated to raise the internal temperature to 85° C., and the system was cooled to room temperature at a rate of 10° C./min when an average circularity of 0.960 was detected with FPIA-2000 (made by Sysmex Corporation). The reaction solution was repeatedly cleaned through filtration, and was then dried.

In the next step, 1 mass % hydrophobic silica (number average primary particle diameter=12 nm, degree of hydrophobization=68) and 1 mass % hydrophobic titanium oxide (number average primary particle diameter=20 nm, degree of hydrophobization=63) were added, and were mixed with a Henschel mixer (made by Mitsui Miike Kakoki K.K.).

Coarse particles were removed through a sieve having an opening of 45 μm. The resulting particles had a volume median particle size of 5.6 μm and an average circularity of 0.965.

A ferrite carrier coated with a silicone resin and having a volume average particle size of 60 μm was further added to the particles such that the toner content was 6 mass %, and was mixed to prepare Toner 14.

<<Determination>>

<Storage Modulus, Loss Modulus>

The storage modulus and the loss modulus were determined with MCR302 (made by Anton Paar GmbH) in accordance with the following procedures (1) to (5).

(1) A toner containing an external additive is placed in a petri dish, is leveled, and is left for 12 hours or more under an environment at a temperature of 20±1° C. and a relative humidity of 50±5%. This sample (0.2 g) is placed in a compression molding machine, and a load of 3 t is applied to the sample for 30 seconds to prepare a pellet having a diameter of 1 cm and a thickness of 3 mm.

(2) The pellet is placed on a parallel plate having a diameter of 10 mm.

(3) The measuring unit is set at a temperature that is 20° C. lower than the softening point of the toner, and the gap of the parallel plate is set at 1.5 mm. These settings allow the measuring unit to be heated to a temperature 20° C. lower than the softening point of the toner and the pellet to be compressed until the gap reaches 1 mm. The toner squeezed out of the parallel plate is scraped off with a spatula. The sample is then cooled to 30° C.

(4) The temperature of the measuring unit is set at 30° C. The measuring unit is heated to 200° C. at a heating rate of 3° C./min while a sinusoidal vibration at a frequency of 1.0 Hz is being applied. The complex modulus of the sample at a temperature within the range of 140 to 180° C. is measured. The interval between points to be measured is 10 seconds. The strain is applied within the range of 0.05 to 15% in an automatic strain control mode.

(5) The storage modulus and the loss modulus are calculated from the complex modulus.

A difference (X) in storage modulus was determined from the maximum value (X1) and the minimum value (X2) of the determined storage modulus. A difference (Y) in storage modulus was determined from the maximum value (Y1) and the minimum value (Y2) of the determined loss modulus.

<Molecular Weight>

The molecular weight was determined by gel permeation chromatography (GPC) as follows.

GPC was performed with a device HLC-8120 GPC (made by Tosoh Corporation) provided with a TSKGUARD column and three TSKGELSUPERHZ-M columns (made by Tosoh Corporation). While the column temperature was kept at 40° C., a carrier solvent tetrahydrofuran (THF) was fed at a flow rate 0.2 ml/min. A sample was dissolved in tetrahydrofuran with an ultrasonic disperser at room temperature for five minutes such that the sample content was 1 mg/ml.

The sample solution (10 μL) filtered through a membrane filter having a pore size of 0.2 μm was injected into the gel permeation chromatograph with the carrier solvent, and the level of components in the sample solution was detected with a refractive index detector (RI detector). The molecular weight distribution of the sample was then calculated from the calibration curve produced with monodispersed standard polystyrene particles. The calibration curve was produced using ten standard polystyrenes.

TABLE 3

| Toner No | Resin particle dispersion | Crystalline polyester resin | Molecular weight of toner Mw ($\times 10^4$) | Mn ($\times 10^4$) | Mw/Mn | Storage modulus at 140 to 180° C. [Pa.] Maximum value (X1) ($\times 10^2$) | Minimum value (X2) ($\times 10^2$) | Difference (X) ($\times 10^2$) | Loss modulus at 140 to 180° C. [Pa.] Maximum value (Y1) ($\times 10^2$) | Minimum value (Y2) ($\times 10^2$) | Difference (Y) ($\times 10^2$) | Notes |
|---|---|---|---|---|---|---|---|---|---|---|---|---|
| 1 | A | a | 3.64 | 1.11 | 3.3 | 5.4 | 4.2 | 1.2 | 8.3 | 5.4 | 2.9 | Invention |
| 2 | B | a | 5.52 | 0.94 | 5.9 | 8.7 | 7.6 | 1.1 | 9.9 | 8.4 | 1.5 | Invention |
| 3 | C | a | 2.82 | 1.34 | 2.1 | 4.5 | 2.5 | 2.0 | 5.6 | 1.6 | 4.0 | Invention |
| 4 | D | a | 2.86 | 1.50 | 1.9 | 5.9 | 3.7 | 2.2 | 8.0 | 2.1 | 5.9 | Invention |
| 5 | E | a | 5.74 | 0.90 | 6.4 | 9.2 | 7.9 | 1.3 | 11.0 | 8.6 | 2.4 | Invention |
| 6 | F | a | 7.51 | 3.07 | 2.4 | 9.9 | 7.3 | 2.6 | 12.0 | 8.0 | 4.0 | Invention |
| 7 | G | a | 2.48 | 1.22 | 2.0 | 3.9 | 1.1 | 2.8 | 7.0 | 1.2 | 5.8 | Invention |
| 8 | A | b | 3.52 | 1.02 | 3.5 | 6.2 | 6.1 | 0.1 | 8.2 | 7.7 | 0.5 | Invention |
| 9 | A | c | 3.73 | 1.16 | 3.2 | 3.9 | 1.9 | 2.0 | 5.5 | 1.5 | 4.0 | Invention |
| 10 | A | d | 3.88 | 1.18 | 3.3 | 4.3 | 1.4 | 2.9 | 6.1 | 0.5 | 5.6 | Invention |
| 11 | A | e | 3.77 | 1.16 | 3.3 | 7.1 | 6.9 | 0.2 | 8.4 | 8.0 | 0.4 | Invention |
| 12 | A | f | 3.58 | 1.10 | 3.3 | 4.9 | 2.9 | 2.0 | 7.0 | 3.0 | 4.0 | Invention |
| 13 | A | g | 3.30 | 0.99 | 3.3 | 4.6 | 1.7 | 2.9 | 7.5 | 1.7 | 5.8 | Invention |
| 14 | M | b | 3.45 | 1.23 | 2.8 | 6.1 | 1.9 | 4.2 | 16.0 | 3.7 | 12.3 | Comparison |
| 15 | A | — | 3.63 | 1.24 | 2.9 | 7.0 | 3.6 | 3.4 | 15.0 | 5.6 | 9.4 | Comparison |
| 16 | H | d | 9.20 | 1.51 | 6.1 | 68.0 | 51.0 | 17.0 | 76.0 | 52.0 | 24.0 | Comparison |
| 17 | I | d | 1.54 | 0.79 | 1.9 | 4.0 | 0.1 | 3.9 | 6.3 | 0.2 | 6.1 | Comparison |

<<Evaluation>>

A carrier was added to the resulting toners to prepare developers for evaluation of the toners, and evaluation was performed as follows.

<Low-Temperature Fixing Characteristics>

The fixing apparatus of a commercially available multifunctional color machine BIZHUB PRO C6500 (made by KONICA MINOLTA, INC.) was modified such that the surface temperature of the upper fixing belt was variable in the range of 140 to 220° C. and the surface temperature of the lower fixing roller was variable in the range of 120 to 200° C. Fixing tests were repeated with this machine as follows: a solid image was fixed onto an NPi high quality paper (128 g/m$^2$) for evaluation (made by Nippon Paper Industries Co., Ltd.) at a fixing rate of 300 mm/sec and a toner density of 11.3 g/m$^2$ while the fixing temperature was stepwise varied from 100° C. to 200° C. at an increment of 5° C.

The print product obtained at each fixing temperature in the fixing test was folded with a paper folder such that a load was applied to the solid image. Compressed air of 0.35 MPa was blown to the folded print product. The folded product was ranked according to the following criteria. The fixing temperature in the fixing test corresponding to Rank 3 was defined as the lower limit of the fixing temperature.

The folded products were evaluated according to the following criteria:

Rank 5: No peel of the toner in the fold.

Rank 4: Partial peel of the toner along the fold.

Rank 3: Peel of the toner in the form of fine lines along the fold.

Rank 2: Peel of the toner in the form of thick lines along the fold.

Rank 1: Noticeable peel of the toner.

The lower limit of the fixing temperature was evaluated according to the following criteria:

◎: 165° C. or less

○: more than 165° C. and 175° C. or less x: more than 175° C.

<High-Temperature Offset Temperature>

Among the fixing temperatures of the fixing test causing no fixing deficits due to hot offset, the highest fixing temperature was defined as the high-temperature offset temperature, and hot offset resistance was evaluated. A toner having the highest fixing temperature of 200° C. or more is determined as acceptable without problems in practical use.

<Evaluation on Gloss Level>

(1) Difference in Gloss Level of Image Between Front and Rear Surfaces of One Sheet in Continuous Double-Sided Printing The gloss level of the fixed image was evaluated with a gloss meter GMX-203 (made by MURAKAMI COLOR RESEARCH LABORATORY) at an angle of 75° in accordance with JIS Z 8741-1997.

The gloss level of a sample image is defined as the average of the gloss levels of five points (the central portion and four corners) of the sample image. The image used in evaluation on the gloss level was formed at a fixing temperature of 160° C. The fixed image was fixed onto a size A4 high glossy paper POD Gross Coat (basis weight of 128 g/m$^2$) (made by Oji Paper Co., Ltd.).

An image was continuously printed on 1000 sheets of a size A4 paper with a copier BIZHUB PRO C6550 (made by KONICA MINOLTA, INC.) under an environment at normal temperature and normal humidity (temperature: 20° C., humidity: 50% RH), and a solid image was double-sided printed on a size A3 paper. The gloss levels of the images formed on both surfaces of the paper were determined with the gloss meter to determine the difference in gloss of the image between the front and rear surfaces of the paper. The front surface of the paper is defined as the surface on which the image is first formed during printing. Evaluation was performed according to the following criteria, and the toners ranked as "◎" and "○" were determined as acceptable.

◎: the difference in gloss level of the image of 1% or less between the front and rear surfaces (acceptable level)

○: the difference in gloss level of more than 1% and less than 5% (acceptable level at which no visual difference is substantially observed)

x: the difference in gloss level of 5% or more (impractical level at which the difference is visually observed)

(2) Difference in Gloss Level of Image Between Sheets in Continuous Double-Sided Printing Double-sided printing was continuously performed on 1000 sheets of a size A4 paper. A solid image was printed on the first sheet and the 1000th sheet of the continuous printing. The difference in gloss level of the image between the front surface of the first sheet and that of the front surface of the 1000th sheet were observed to determine the difference in gloss level of the image between the sheets. The gloss level was determined by the same procedure as above. Evaluation was performed according to the following criteria. Toners ranked as "◎" and "○" were determined as acceptable.

◎: the difference in gloss level of the image of 1% or less between the front surface of the first sheet and that of the front surface of the 1000th sheet (acceptable level)

○: the difference in gloss level of more than 1% and less than 5% (acceptable level at which no visual difference is substantially observed)

x: the difference in gloss level of 5% or more (impractical level at which the difference is visually observed)

The results are shown in Table 4.

The results show that the gloss levels of the images printed with the toners according to the present invention were higher than those of the images printed with the toners according to Comparative Examples in comparison of the gross level between the front and rear surfaces of one sheet in double-sided printing and between sheets in continuous printing. The results also show that the gloss levels of the images printed with the toners according to the present invention were higher than those of the images printed with the toners according to Comparative Examples in the difference in gloss level of the image between the front surface of the first sheet and that of the 1000th sheet.

This U.S. patent application claims priority to Japanese patent application No. 2015-062441 filed on Mar. 25, 2015, the entire contents of which are incorporated by reference herein for correction of incorrect translation.

What is claimed is:

1. A toner for developing electrostatic latent images, the toner containing a particulate toner which at least comprises a colorant, a binder resin, a mold release agent, and a crystalline polyester resin, wherein the binder resin contains a styrene-acrylic resin, the toner has a storage modulus G' [Pa], a difference (X) between the maximum value and the minimum value of the storage modulus G', and a difference (Y) between the maximum value and the minimum value of a loss modulus G" [Pa] within the range of 140 to 180° C. satisfying relationships expressed by Conditional expressions (1) to (3):

$1.0\times10^2 \leq G' \leq 1.0\times10^3$ Conditional expression (1):

$0 \leq X \leq 3.0\times10^2$ Conditional expression (2):

$0 \leq Y \leq 6.0\times10^2$, and Conditional expression (3):

the crystalline polyester resin includes a crystalline polyester resin composed of a polymerizable vinyl monomer and a polymerizable polyester monomer bonded to the polymerizable vinyl monomer.

TABLE 4

| | | | Gloss level (1st sheet) [%] | | | | Gloss level (1000th sheet) [%] | | | | Difference | | |
|---|---|---|---|---|---|---|---|---|---|---|---|---|---|
| Toner No | Low-temperature fixing characteristics | High-temperature offsetting temperature [° C.] | Front surface | Rear surface | Difference in gloss level of image between front and rear surfaces of one sheet | Evaluation | Front surface | Rear surface | Difference in gloss level of image between front and rear surfaces of one sheet | Evaluation | in gloss level of image between from surface of 1st sheet and that of 1000th sheet | Evaluation | Notes |
| 1 | ◎ | 210 | 60.4 | 60.1 | 0.3 | ◎ | 60.6 | 60.5 | 0.1 | ◎ | 0.2 | ◎ | Invention |
| 2 | ○ | 220 | 56.8 | 56.4 | 0.4 | ◎ | 56.8 | 56.3 | 0.5 | ◎ | 0.0 | ◎ | Invention |
| 3 | ◎ | 200 | 65.7 | 64.9 | 0.8 | ◎ | 65.1 | 64.4 | 0.4 | ◎ | 0.6 | ◎ | Invention |
| 4 | ◎ | 200 | 67.4 | 64.9 | 2.5 | ○ | 70.5 | 66.9 | 3.6 | ○ | 3.1 | ○ | Invention |
| 5 | ○ | 220 | 54.2 | 53.8 | 0.4 | ◎ | 54.0 | 53.9 | 0.1 | ◎ | 0.2 | ◎ | Invention |
| 6 | ○ | 220 | 51.3 | 49.0 | 2.3 | ○ | 49.1 | 46.6 | 2.5 | ○ | 2.2 | ○ | Invention |
| 7 | ◎ | 200 | 68.5 | 64.3 | 4.2 | ○ | 71.1 | 68.5 | 2.6 | ○ | 2.6 | ○ | Invention |
| 8 | ○ | 220 | 58.1 | 57.4 | 0.7 | ◎ | 59.0 | 58.1 | 0.9 | ◎ | 0.9 | ◎ | Invention |
| 9 | ◎ | 205 | 67.1 | 66.0 | 1.1 | ○ | 68.8 | 67.4 | 1.4 | ○ | 1.7 | ○ | Invention |
| 10 | ◎ | 200 | 67.9 | 64.2 | 3.7 | ○ | 70.6 | 66.1 | 4.5 | ○ | 2.7 | ○ | Invention |
| 11 | ○ | 220 | 57.8 | 57.4 | 0.4 | ◎ | 58.3 | 57.7 | 0.6 | ◎ | 0.5 | ◎ | Invention |
| 12 | ◎ | 200 | 67.5 | 66.3 | 1.2 | ○ | 69.0 | 67.7 | 1.3 | ○ | 1.5 | ○ | Invention |
| 13 | ◎ | 200 | 68.4 | 64.6 | 3.8 | ○ | 67.0 | 63.5 | 3.5 | ○ | 1.4 | ○ | Invention |
| 14 | ◎ | 200 | 67.2 | 61.8 | 5.4 | X | 70.5 | 64.1 | 6.4 | X | 3.3 | ○ | Comparison |
| 15 | X | 220 | 54.2 | 49.0 | 5.2 | X | 56.6 | 51.3 | 5.3 | X | 2.4 | ○ | Comparison |
| 16 | X | 220 | 44.1 | 40.4 | 3.7 | ○ | 49.2 | 45.9 | 3.3 | ○ | 5.1 | X | Comparison |
| 17 | X | 190 | 69.9 | 68.1 | 1.8 | ○ | 75.2 | 70.8 | 4.4 | ○ | 5.3 | X | Comparison |

2. The toner for developing electrostatic latent images according to claim 1, wherein the ratio of a weight average molecular weight (Mw) of the toner to a number average molecular weight (Mn) of the toner satisfies Conditional expression (4): $2.0 \leq Mw/Mn \leq 6.0$.

3. The toner for developing electrostatic latent images according to claim 1, wherein the weight average molecular weight (Mw) of the toner ranges from 25000 to 60000, and the number average molecular weight (Mn) of the toner ranges from 8000 to 15000.

4. The toner for developing electrostatic latent images according to claim 1, wherein the content of the polymerizable vinyl monomer in the crystalline polyester resin is within the range of 1 to 30 mass % of the total mass of the crystalline polyester resin composed of the polymerizable vinyl monomer and the polymerizable polyester monomer bonded to the polymerizable vinyl monomer.

5. The toner for developing electrostatic latent images according to claim 1, wherein the crystalline polyester resin contains a non-modified crystalline polyester resin.

6. The toner for developing electrostatic latent images according to claim 1, wherein the crystalline polyester resin has an acid value within the range of 5 to 30 mgKOH/g.

* * * * *